US005480765A

United States Patent [19]

Yanagihara et al.

[11] Patent Number: 5,480,765

[45] Date of Patent: Jan. 2, 1996

[54] RECORDING MATERIAL

[75] Inventors: Naoto Yanagihara; Masanobu Takashima; Masato Shimazaki; Ken Iwakura; Tomohiro Kodama, all of Shizuoka, Japan

[73] Assignee: Fuji Photo Film Co., Ltd., Kanagawa, Japan

[21] Appl. No.: 239,126

[22] Filed: May 6, 1994

[30] Foreign Application Priority Data

| | | | |
|---|---|---|---|
| May 10, 1993 | [JP] | Japan | 5-108437 |
| May 12, 1993 | [JP] | Japan | 5-110490 |
| Feb. 14, 1994 | [JP] | Japan | 6-017619 |
| Feb. 14, 1994 | [JP] | Japan | 6-017620 |
| Mar. 1, 1994 | [JP] | Japan | 6-031462 |

[51] Int. Cl.[6] ..... B41M 5/30

[52] U.S. Cl. ..... 430/338; 430/332; 503/209

[58] Field of Search ..... 503/209; 430/332, 430/338, 340

[56] References Cited

U.S. PATENT DOCUMENTS

| | | | |
|---|---|---|---|
| 3,932,424 | 1/1976 | Albrecht et al. | 260/293.61 |
| 4,384,871 | 5/1983 | Asano et al. | 8/599 |
| 5,210,065 | 5/1993 | Tanaka et al. | 503/202 |

FOREIGN PATENT DOCUMENTS

| | | | |
|---|---|---|---|
| 0289122 | 2/1988 | European Pat. Off. . | |
| 50-011294 | 4/1975 | Japan . | |
| 52-150118 | 12/1977 | Japan . | |
| 53-011036 | 2/1978 | Japan | 503/209 |
| 55-121833 | 9/1980 | Japan . | |
| 58-118290 | 7/1983 | Japan | 503/209 |
| 60-030387 | 2/1985 | Japan | 503/209 |
| 60-040292 | 3/1985 | Japan | 503/209 |
| 61-022984 | 1/1986 | Japan | 503/209 |
| 61-137770 | 6/1986 | Japan . | |
| 61-160287 | 7/1986 | Japan . | |

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

A recording material employing an electron-donating achromatic dye and an electron-accepting compound, which further contains at least one triarylamine derivative represented by general: formula (1), (2), (3) or (4);

general formula (1)

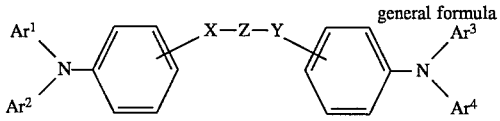

general formula (2)

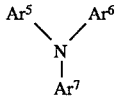

general formula (3)

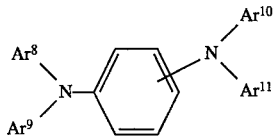

general formula (4)

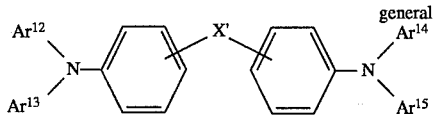

wherein all the symbols are defined in the specification.

5 Claims, No Drawings

RECORDING MATERIAL

FIELD OF THE INVENTION

The present invention relates to a recording material. More particularly, it relates to a recording material improved in lightfastness of developed color.

BACKGROUND OF THE INVENTION

Recording materials employing an electron-donating achromatic dye and an electron-accepting compound are already well known as pressure-sensitive paper, heat-sensitive recording paper, photo- and pressure-sensitive paper, heat-sensitive recording paper of the electricity application type, heat-sensitive transfer paper, etc. Such recording materials are described in detail in, e.g., British Patent 2,140,449, U.S. Pat. Nos. 4,480,052 and 4,436,920, JP-B-60 -23992, JP-A-57-179836, JP-A-60-123556, and JP-A-60-123557. (The terms "JP-B" and "JP-A" as used herein mean an "examined Japanese patent publication" and an "unexamined published Japanese patent application," respectively.)

In the field of such recording materials, intensive investigations have recently been made on improvements in such properties as density of developed color and fastness of developed color.

Although attempts have been made to improve lightfastness of developed color by using an additive such as an antioxidant, singlet oxygen quencher, UV absorber, or aromatic amine derivative, this technique has problems, for example, that the additive itself has been colored and the effect produced thereby is insufficient.

Several recording materials employing an aromatic amine derivative are known. Recording materials employing a diarylamine derivative are disclosed in, e.g., JP-A-61-137770 and JP-A-61-160287, while one employing a triarylamine derivative is disclosed in JP-B-50-11294. However, these recording materials are defective in that the improvement in lightfastness of developed color is insufficient.

SUMMARY OF THE INVENTION

As a result of intensive studies made by the present inventors on improvement of lightfastness of developed color, it has been found that a triarylamine derivative which has not been used thus far improves lightfastness of developed color.

An object of the present invention is to provide a recording material in which a developed color has good lightfastness.

The above object is accomplished with a recording material employing an electron-donating achromatic dye and an electron-accepting compound, which further contains a triarylamine derivative represented by the following general formula (1), (2), (3) or (4).

General Formula (1):

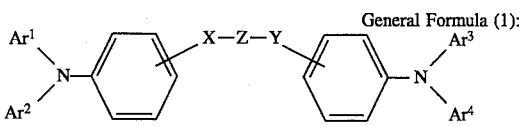

General Formula (2):

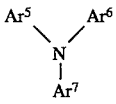

-continued

General Formula (3):

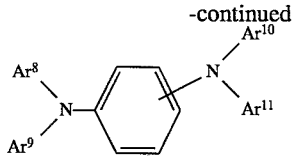

General Formula (4):

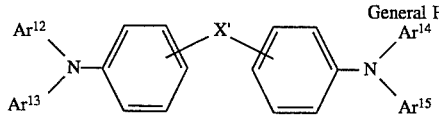

In general formula (1), $Ar^1$, $Ar^2$, $Ar^3$, and $Ar^4$ each represents an unsubstiuted aryl group or an aryl group substituted by an alkyl, alkenyl, alkynyl, aryl, alkoxy, aryloxy, alkylthio, or arylthio group, X and Y each represents an oxygen atom or a sulfur atom, and Z represents an alkylene group, a phenylene group, or an alkanedioyl group. In general formula (2), at least one of $Ar^5$ $Ar^6$ and $Ar^7$ represents an aryl group substituted by an alkoxy, aryloxy, alkylthio or arylthio group and the remainder each represents an unsubstituted aryl group or an aryl group substituted by an alkyl, alkenyl, alkynyl, aryl, alkoxy, aryloxy, alkylthio, or arylthio group.

In general formula (3), $Ar^8$, $Ar^9$, $Ar^{10}$ and $Ar^{11}$ each represents an unsubstituted aryl group or an aryl group substituted by an alkyl, alkoxy or aryloxy group.

In general formula (4), $Ar^{12}$, $Ar^{13}$, $Ar^{14}$ and $Ar^{15}$ each represents an unsubstituted aryl group or an aryl group substituted by an alkyl, alkenyl, alkynyl, aryl, alkoxy, aryloxy, alkylthio, or arylthio group, X' represents an oxygen atom, a sulfur atom or a bivalent linking group represented by general formula (a), (b) or (c):

General Formula (a):

$$-C_kH_{2k}-$$

General Formula (b)

$$-C_mH_{2m}-CH=CH-C_nH_{2n}-$$

General Formula (c):

$$-C_pH_{2p}-C\equiv C-C_qH_{2q}-$$

In the above formulae (a) to (c), k is an integer of 2 to 20, and m, n, p and q each is an integer of 0 to 20.

DETAILED DESCRIPTION OF THE INVENTION

In general formula (1) above, $Ar^1$, $Ar^2$, $Ar^3$, and $Ar^4$ each preferably is phenyl, naphthyl, or anthryl group, especially phenyl group. These groups also may have a substituent.

In the case where $Ar^1$, $Ar^2$, $Ar^3$, and $Ar^4$ in general formula (1) above are substituted aryl groups, the substituents may be identical or may include two or more different ones. Preferred examples of the substituents include alkyl groups having 1 to 30 carbon atoms, alkenyl groups having 2 to 20 carbon atoms, alkynyl groups having 2 to 20 carbon atoms, aryl groups having 6 to 20 carbon atoms, alkoxy groups having 1 to 30 carbon atoms, aryloxy groups having 6 to 20 carbon atoms, alkylthio groups having 1 to 30 carbon atoms, and arylthio groups having 6 to 20 carbon atoms. These substituents also may be substituted by an alkyl group, an alkoxy group, an aryl group, or an aryloxy group.

Especially preferred examples of the substituents, in the case where $Ar^1$, $Ar^2$, $Ar^3$, and $Ar^4$ in general formula (1) are substituted aryl groups, include alkyl groups having 1 to 20 carbon atoms, alkenyl groups having 2 to 10 carbon atoms, alkynyl groups having 2 to 10 carbon atoms, aryl groups having 6 to 15 carbon atoms, alkoxy groups having 1 to 20 carbon atoms, aryloxy groups having 6 to 15 carbon atoms, alkylthio groups having 1 to 20 carbon atoms, and arylthio groups having 6 to 15 carbon atoms.

Preferred specific examples of $Ar^1$, $Ar^2$, $Ar^3$, and $Ar^4$ include phenyl, naphthyl, anthryl, tolyl, ethylphenyl, isopropylphenyl, n-butylphenyl, n-hexylphenyl, methoxyphenyl, ethoxyphenyl, n-propoxyphenyl, isopropoxyphenyl, n-butoxyphenyl, isobutyloxyphenyl, sec-butyloxyphenyl, n-pentyloxyphenyl, isopentyloxyphenyl, n-hexyloxyphenyl, n-octyloxyphenyl, (2-ethylhexyl)phenyl, n-nonyloxyphenyl, n-decyloxyphenyl, n-dodecyloxyphenyl, n-octadecyloxyphenyl, phenylphenyl, phenoxyphenyl, (4-methoxyphenoxy)phenyl, (2-methoxyethoxy)phenyl, [2-(2-methoxyethoxy)ethoxy]phenyl, methylthiophenyl, ethylthiophenyl, n-butylthiophenyl, n-decylthiophenyl, phenylthiophenyl, dimethylphenyl, trimethylphenyl, dimethoxyphenyl, trimethoxyphenyl, methylenedioxyphenyl, methoxytolyl, and methoxydimethylphenyl.

It is preferred that in general formula (1) given above the oxygen atom or sulfur atom represented by each of X and Y be at a position para or meta to the nitrogen atom. In the case where both X and Y are at positions meta to the nitrogen atoms, it is preferable that at least one of the substituents of the aryl groups $Ar^1$, $Ar^2$, $Ar^3$, and $Ar^4$ be an alkoxy, aryloxy, alkylthio, or arylthio group bonded at the position para to the nitrogen atom. In the case where X and Y each is at the position para to the nitrogen atom, the substituents of the aryl groups $Ar^1$, $Ar^2$, $Ar^3$, and $Ar^4$ each is preferably at a position meta or para to the nitrogen atom.

In general formula (1) given above, the alkylene group, phenylene group, or alkanedioyl group represented by Z may have a substituent. Preferred of these are groups represented by general formulae (d), (e), and (f).

General Formula (d):

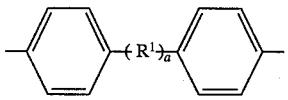

In formula (d), $R^1$ represents an alkylene or a phenylene group each having 1 to 20 carbon atoms which may be substituted and may have a heteroatom or an unsaturated bond in the chain, and a is an integer of 0 or 1.

General Formula (e):

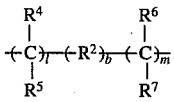

In formula (e), $R^2$ represents an alkylene or a phenylene group each having 1 to 20 carbon atoms which may be substituted and may have a heteroatom or an unsaturated bond in the chain; $R^4$, $R^5$, $R^6$, and $R^7$ may be the same or different and each represents a hydrogen atom, an alkyl group having 1 to 20 carbon atoms which may be substituted, or an aryl group having 6 to 20 carbon atoms which may be substituted; b is an integer of 0 or 1; and 1 and m each is an integer of 0 to 4.

General Formula (f):

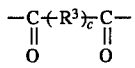

In formula (f), $R^3$ represents an alkylene or a phenylene group each having 1 to 20 carbon atoms which may be substituted and may have a heteroatom or an unsaturated bond in the chain, and c is an integer of 0 or 1.

In the case where the alkylene or phenylene group represented by $R^1$, $R^2$, or $R^3$ in general formulae (d) to (f) above has a substituent, the substituent preferably is an alkyl group having 1 to 10 carbon atoms, an aryl group having 6 to 10 carbon atoms, or an alkoxy group having 1 to 10 carbon atoms. In the case where the alkylene or phenylene group has a heteroatom or an unsaturated bond in the chain, the heteroatom is preferably an oxygen atom and the unsaturated bond is preferably a double bond or a triple bond. Especially preferred examples of $R^1$, $R^2$, and $R^3$ are as follows.

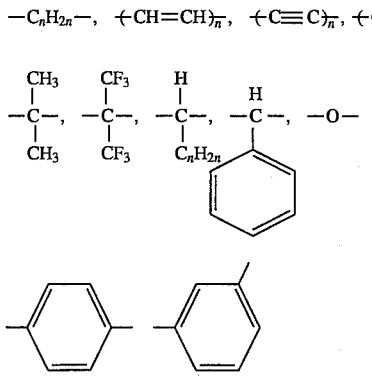

In the above formulae, n is an integer of 1 to 5.

In general formula (e) given above, when the substituents represented by $R^4$, $R^5$ $R^6$ and $R^7$ each is an alkyl group or an aryl group, the alkyl group is preferably one having 1 to 10 carbon atoms and the aryl group is preferably one having 6 to 12 carbon atoms. These substituents may have a substituent such as an alkyl group having 1 to 6 carbon atoms, a phenyl group, an alkoxy group having 1 to 6 carbon atoms, or an aryloxy group having 1 to 10 carbon atoms.

Specific examples of the triarylamine derivative represented by general formula (1) according to the present invention are given below, but these compounds are not construed to be limiting the scope of the invention.

The examples include 1,2-bis(p-diphenylaminophenoxy-)ethane, 1,2-bis(p-diphenylaminophenoxy)propane, 1,2-bis(p-diphenylaminophenoxy)- 3-phenylpropane, 1,3-bis(p-diphenylaminophenoxy)propane, 2,2-dimethyl-1,3-bis(p-diphenylaminophenoxy)propane, 1,4-bis(p-diphenylaminophenoxy)butane, 1,5-bis(p-diphenylaminophenoxy)pentane, 1,8-bis(4-diphenylaminophenoxy)octane, 1,12-bis(p-diphenylaminophenoxy)dodecane, 1,18-bis(p-diphenylaminophenoxy-)octadecane, 1,2-dimethyl-1,2-bis(p-diphenylaminophenoxy)ethane, 1,4-bis(p-diphenylaminophenoxy)-2-butene, 1,2-bis[p-di(p-tolylamino)phenoxy] ethane, 1,2-bis[p-di(p-tolylamino)phenoxy] -3-phenylpropane, 1,3-bis[p-di(p-tolylamino)phenoxy] propane, 1,4-bis[p-di(p-tolylamino)phenoxy]butane, 1,6-bis[p-di(p-tolylamino)phenoxy]hexane, 1,12-bis[p-di(p-tolylamino)phenoxy] dodecane, 1,4-bis[p-di(p-tolylamino)phenoxy] -2-butene, bis[p-bis(p-methoxyphenylamino)phenoxy]methane, 1,2-bis [p-bis(p-methoxyphenylamino)phenoxy] ethane, 1,2-bis[p-bis(p-methoxyphenylamino)phenoxy]- 3-methylpropane, 1,3-bis [p-bis (p-methoxyphenyl)aminophenoxy] propane, 2,2-dimethyl-1,3-bis [p-bis (p-methoxyphenylamino)phenoxy] propane, 1,4-bis[p-bis(p-methoxyphenylamino)phenoxy] butane, 1,10-bis[p-bis(p-methoxyphenylamino)phenoxy] decane, 1,4 -bis[p-bis(p-methoxyphenylamino)phenoxy] -2-butene, 1,2-bis[p-bis(m-tolylamino)phenoxy] ethane, 1,2-bis[p-bis(m-methoxyphenylamino)phenoxy] ethane, 1,2-bis[p-[N-(p-methoxyphenyl)-N-(p-tolyl)amino] phenoxy]ethane, 1,2-bis[p-[N-(p-methoxyphenyl)-N-(p-tolyl)amino] phenoxy]propane, 1,3-bis[p-[N-(p-methoxyphenyl)-N-(p-tolyl)amino] phenoxy]propane, 1,4-bis[p-[N-(p-methoxyphenyl)-N-(p-tolyl)amino] phenoxy]butane, 1,2-bis [p-[N-(p-methoxyphenyl)-N-phenylamino] phenoxy] ethane, 1,2-bis[p-[N-(p-methoxyphenyl) -N-phenylamino] phenoxy]propane, 1,3-bis[p-[ N-(p-methoxyphenyl)-N-phenylamino]phenoxy]propane, 1,4-bis[ p-[N-(p-methoxyphenyl)-N-phenylamino]phenoxy]butane, 1,2-bis(m-diphenylaminophenoxy)ethane, 1,4-bis(m-diphenylaminophenoxy)butane, 1,2-bis[m-bis(p-tolylamino)phenoxy]ethane, 1,4-bis[m-bis(p-tolylamino)phenoxy]butane, 1,2-bis[ m-bis(p-methoxyphenylamino)phenoxy]ethane, 1,4-bis[ m-bis(p-methoxyphenylamino)phenoxy]butane, 1,2-bis[m-[ N-(p-methoxyphenyl)-N-(p-tolyl)amino]phenoxy]ethane, 1,4-bis [m-[ N-(p-methoxyphenyl)-N-phenylamino]phenoxy] butane, 1,2-bis[m-[ N-(p-tolyl)-N-phenylamino]phenoxy] ethane, 1-(p-diphenylaminophenoxy)- 2-[p-bis(p-tolylamino)phenoxy]ethane, 1-(p-diphenylaminophenoxy)-4-[p-bis(p-methoxyphenylamino)phenoxy]butane, 1-[ p-bis(p-tolylamino)phenoxy]-2-[p-bis(p-methoxyphenylamino)phenoxy] ethane, 1-[m-bis(p-tolylamino)phenoxy]-2-[p-bis(p-methoxyphenylamino)phenoxy] ethane, 1-[m-diphenylaminophenoxy]-2-[p-bis(p-methoxyphenylamino)phenoxy]ethane, 1,2-bis[p-bis(p-methoxyphenylamino)phenylthio]ethane, 1,4-bis[ p-bis(p-methoxyphenylamino)phenylthio]butane, 1-(p-diphenylaminophenylthio)-2-[ p-bis(p-methoxyphenylamino)phenoxy] ethane, 1-[p-bis(p-methoxyphenylamino)phenylthio] -2-[p-bis(p-methoxyphenylamino)phenoxy]ethane, 1-[ p-bis(p-tolylamino)phenylthio]-2-[p-bis(p-methoxyphenylamino)phenoxy] ethane, 1,4-bis(p-diphenylaminophenoxy)benzene, 1,4-bis[p-bis(p-tolylamino)phenoxy]benzene, 1,4-bis[p-bis(p-methoxyphenylamino)phenoxy] benzene, 1,4-bis[p-bis(p-n-butoxyphenylamino)phenoxy] benzene, 1,4-bis[p-bis(p-n-octyloxyphenylamino)phenoxy] benzene, 1-(p-diphenylaminophenoxy)- 4-[p-bis(p-methoxyphenylamino)phenoxy]benzene, 1,3-bis(p-diphenylaminophenoxy)benzene, 1,3-bis[p-bis(p-tolylamino)phenoxy]benzene, 1,3-bis[ p-bis(p-methoxyphenylamino)phenoxy] benzene, 1-(p-diphenylaminophenoxy)-3-[p-bis(p-tolylamino)phenoxy] benzene, 4,4' -bis(p-diphenylaminophenoxy)biphenyl, 4,4'-bis[p-bis(p-tolylamino)phenoxy]biphenyl, 4,4'-bis[p-bis(p-methoxyphenylamino)phenoxy]-biphenyl, 4,4'-bis[p-bis(p-n-octyloxyphenylamino)phenoxy] biphenyl, 4,4'-bis[p-bis [p-(2-ethylhexyloxy)phenylamino]phenoxy]biphenyl, 4-(p-diphenylaminophenoxy)-4'-[ p-bis(p-methoxyphenylamino)phenoxy]biphenyl, α,α'-bis[p-diphenylaminophenoxy] -p-xylene, α,α'-bis[p-bis(p-tolylamino)phenoxy] -p-xylene, α,α'-bis[p-bis(p-methoxyphenylamino)phenoxy] -p-xylene, α-(p-diphenylaminophenoxy)-α'-[p-bis(p-methoxyphenylamino)phenoxy] -p-xylene, α,α'-bis[p-diphenylaminophenoxy]-m-xylene, α,α'-bis[ p-bis(p-tolylamino)phenoxy]-m-xylene, α,α'-bis[p-bis(p-methoxyphenylamino)phenoxy] -m-xylene, α-[p-bis(p-tolylamino)phenoxy]-α'-[p-bis(p-methoxyphenylamino)phenoxy] -m-xylene, bis[4-(p-diphenylaminophenoxy)phenyl]ether, bis[4 -[bis(p-tolylamino)phenoxy]phenyl]ether, bis[4-[ bis(p-methoxyphenylamino) phenoxy]phenyl]ether, bis[4-[ bis(p-n-butyloxyphenylamino) phenoxy]phenyl]ether, bis[4-[ bis(p-n-octyloxyphenylamino) phenoxy]phenyl]ether, p-(diphenylaminophenoxy)phenyl p-[bis(p-methoxyphenylamino)phenoxy]-phenyl ether, 2,2-bis[4-[bis(p-methoxyphenylamino)phenoxy] -phenyl]propane, 2,2-bis[4-[ bis(p-n-butyloxyphenylamino)phenoxy]phenyl]propane, 2,2-bis [4-[ bis(p-n-octyloxyphenylamino)phenoxy]phenyl] propane, 2-[4 -(diphenylaminophenoxy)phenyl]-2-[4-[bis(p-methoxyphenylamino)phenoxy] phenyl]propane, 2,2-bis[4-[bis(p-methoxyphenylamino)phenoxy] phenyl] hexafluoropropane, 2,2-bis[4-[bis(p-n-butyloxyphenylamino)phenoxy] phenyl]hexafluoropropane, 2,2-bis[4-[bis(p-n-octyloxyphenylamino)phenoxy]phenyl] hexafluoropropane, bis[4-(p-diphenylaminophenoxy)ethyl] ether, bis[4-[bis(p-tolylamino)phenoxy]ethyl]ether, bis[4 -[bis(p-methoxyphenylamino)phenoxy]ethyl]ether, 1,2-bis[2-[4 -(p-diphenylaminophenoxy)]ethoxy]ethane, 1,2-bis[4-[ bis(p-methoxyphenylamino)phenoxy]carbonyl]ethane, 1,4-bis[4-[ bis(p-methoxyphenylamino)phenoxy]carbonyl]butane, 1,8-bis[4-[ bis(p-methoxyphenylamino)phenoxy]carbonyl]octane, 1,8-bis[p-bis(1 -naphthylamino)phenoxy]octane, 1,6-bis[p-bis(2 -naphthylamino)phenoxy]hexane, 1,8-bis[p-bis(4 -methoxy-1-naphthylamino)phenoxy]octane, 1,6-bis [p-bis(2 -naphthylamino)phenoxy]hexane, 1,4-bis[p-bis(1-anthrylamino)phenoxy]butane, 1,2-bis[p-bis(2-anthrylamino)phenoxy]ethane, 1,6-bis[p-bis(9 anthrylamino) phenoxy]hexane, 1,2-bis [p-bis (3,4 -dimethoxyphenylamino) phenoxy]ethane, 1,3-bis [p-bis (2,4 -dimethoxyphenylamino) phenoxy]propane, 1,4-bis [p-bis (3-methyl-4 -methoxyphenylamino)phenoxy]butane, 1,2-bis[p-bis(2-methyl-4 -methoxyphenylamino)phenoxy] ethane, 1,3-bis[p-bis(3,4 -methylenedioxyphenylamino)phenoxy]propane, and 1,4-bis[p-bis( 3,4-dimethylphenylamino)phenoxy]butane.

The triarylamine derivative represented by general formula (2) will be described below in detail.

In general formula (2) given hereinabove, $Ar^5$, $Ar^6$, and $Ar^7$ each preferably is phenyl, naphthyl, or anthryl group, especially phenyl group. These groups may have a substituent.

In the case where at least one of $Ar^5$, $Ar^6$, and $Ar^7$ in general formula (2) is an aryl group substituted by an alkoxy, aryloxy, alkylthio or arylthio group, preferred examples of the substituent include alkoxy groups having 1 to 30 carbon atoms, aryloxy groups having 6 to 20 carbon atoms, alkylthio groups having 1 to 30 carbon atoms, and arylthio groups having 6 to 20 carbon atoms. Especially preferred of these are alkoxy groups having 1 to 20 carbon atoms, aryloxy groups having 6 to 15 carbon atoms, alkylthio groups having 1 to 20 carbon atoms, and arylthio groups having 6 to 15 carbon atoms. These substituents also may be substituted by an alkyl group, an alkoxy group, an aryl group, or an aryloxy group. It is preferred that those substituents be at the position para to the nitrogen atom of the triphenylamine.

In the case where any of the remainder of $Ar^5$ $Ar^6$ and $Ar^7$ in general formula (2) is an aryl group substituted by an alkyl, alkenyl, alkynyl, aryl, alkoxy, aryloxy, alkylthio, or arylthio group, preferred examples of the substituent include alkyl groups having 1 to 30 carbon atoms, alkenyl groups having 2 to 30 carbon atoms, alkynyl groups having 2 to 30 carbon atoms, aryl groups having 6 to 20 carbon atoms, alkoxy groups having 1 to 30 carbon atoms, aryloxy groups having 6 to 20 carbon atoms, alkylthio groups having 1 to 30 carbon atoms, and arylthio groups having 6 to 20 carbon atoms. Especially preferred of these are alkyl groups having 1 to 20 carbon atoms, alkenyl groups having 2 to 10 carbon atoms, alkynyl groups having 2 to 10 carbon atoms, aryl groups having 6 to 15 carbon atoms, alkoxy groups having 1 to 20 carbon atoms, aryloxy groups having 6 to 15 carbon atoms, alkylthio groups having 1 to 20 carbon atoms, and arylthio groups having 6 to 15 carbon atoms. These substituents may also be substituted by an alkyl group, an alkoxy group, an aryl group, or an aryloxy group.

Preferred specific examples of at least one of $Ar^5$, $Ar^6$, and $Ar^7$ include methoxyphenyl, ethoxyphenyl, n-propoxyphenyl, isopropoxyphenyl, n-butoxyphenyl, isobutyloxyphenyl, sec-butyloxyphenyl, n-pentyloxyphenyl, isopentyloxyphenyl, n-hexyloxyphenyl, n-octyloxyphenyl, (2-ethylhexyl)phenyl, n-nonyloxyphenyl, n-decyloxyphenyl, n-dodecyloxyphenyl, n-octadecyloxyphenyl, phenylphenyl, phenoxyphenyl, (4-methoxyphenoxy)phenyl, (2-methoxyethoxy)phenyl, [2-(2-methoxyethoxy)ethoxy]phenyl, methylthiophenyl, ethylthiophenyl, n-butylthiophenyl, n-decylthiophenyl, phenylthiophenyl, dimethoxyphenyl, trimethoxyphenyl, methylenedioxyphenyl, methoxytolyl, and methoxydimethylphenyl.

Preferred specific examples of the remainder of $Ar^5$, $Ar^6$, and $Ar^7$ include phenyl, naphthyl, anthryl, tolyl, ethylphenyl, isopropylphenyl, n-butylphenyl, n-hexylphenyl, n-octylphenyl, methoxyphenyl, ethoxyphenyl, n-propoxyphenyl, isopropoxyphenyl, n-butoxyphenyl, isobutyloxyphenyl, sec-butyloxyphenyl, n-pentyloxyphenyl, isopentyloxyphenyl, n-hexyloxyphenyl, n-octyloxyphenyl, (2-ethylhexyl)phenyl, n-nonyloxyphenyl, n-decyloxyphenyl, n-dodecyloxyphenyl, n-octadecyloxyphenyl, phenylphenyl, phenoxyphenyl, (4-methoxyphenoxy)phenyl, (2-methoxyethoxy)phenyl, [2-(2-methoxyethoxy)ethoxy] phenyl, methylthiophenyl, ethylthiophenyl, n-butylthiophenyl, n-decylthiophenyl, phenylthiophenyl, dimethylphenyl, trimethylphenyl, dimethoxyphenyl, trimethoxyphenyl, methylenedioxyphenyl, methoxytolyl, and methoxydimethylphenyl.

In the case where $Ar^5$, $Ar^6$, and $Ar^7$ in general formula (2) given above are bonded to each other to form a condensed ring having a heteroatom or a double bond, preferred examples of the condensed ring are as follows.

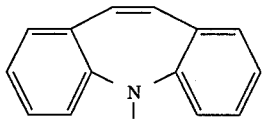

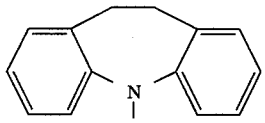

-continued

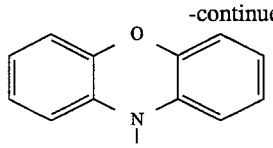

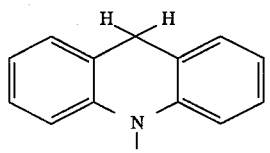

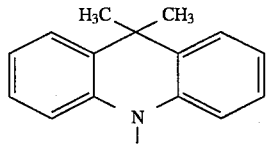

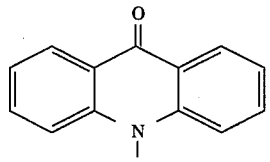

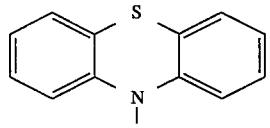

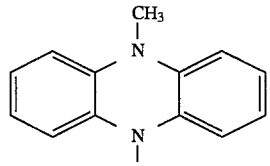

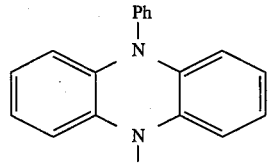

Specific examples of the triarylamine derivative represented by general formula (2) according to the present invention are given below, but these examples are not construed to be limiting the scope of the invention.

The examples include 4-methoxytriphenylamine, 4-ethoxytriphenylamine, 4-n-butoxytriphenylamine, 4-n-octyloxytriphenylamine, 4-n-dodecyloxytriphenylamine, 4-phenoxytriphenylamine, 4-methoxy-4'-methyltriphenylamine, 4-methoxy- 4'-phenyltriphenylamine, 4-methoxy-4',4"-dimethyl-triphenylamine, 4-ethoxy-3'-methyltriphenylamine, 4-n-hexyloxy- 3',3"-dimethyltriphenylamine, 4-n-octyloxy- 3',3",4',4"-tetramethyltriphenylamine, 4,4'-dimethoxytriphenylamine, 4,4'-diethoxytriphenylamine, 4,4'-di-n-butoxytriphenylamine, 4,4'-di(2-ethylhexyloxy)triphenylamine, 4,4'-di-n-decyloxytriphenylamine, 4-methoxy-4'-ethoxytriphenylamine, 4-methoxy-4,-isopropyloxytriphenylamine, 4-methoxy- 4'-n-butyloxytriphenylamine, 4-methoxy-4'-n-octyloxytriphenylamine, 4-ethoxy-4'-n-butyloxytriphenylamine, 3,4-methylenedioxytriphenylamine, 4,4'-dimethoxy-4"-methyltriphenylamine, 4,4,-dimethoxy-3"-methyltriphenylamine, 4,4'-dimethoxy- 3",4"-dimethyltriphenylamine, 4,4'-dimethoxy-3-methyltriphenylamine, 4',4"-dimethoxy-4-ethyltriphenylamine, 4',4"-dimethoxy-4-n-butyltriphenylamine, 4',4"-dimethoxy-3 -n-isopropyltriphenylamine, 4,4,-dimethoxy-4"-phenyltriphenylamine, 4,4'-dimethoxy-4"-β-styryltriphenylamine, 4,4'-dimethoxy-4"-phenylethynyltriphenylamine, 2,3,4-trimethoxytriphenylamine, 3,4,5-trimethoxytriphenylamine, 2,2',4"-trimethoxytriphenylamine, 3,4,4'-trimethoxytriphenylamine, 2,4,4'-trimethoxytriphenylamine, 2,4',4"-trimethoxytriphenylamine, 3,4',4"-trimethoxytriphenylamine, 4,4',4"-trimethoxytriphenylamine, 4-methoxy-3',4'-methylenedioxytriphenylamine, 2,3,4,5-tetramethoxytriphenylamine, 3,4,5,4'-tetramethoxytriphenylamine, 2,4,2',4'-tetramethoxytriphenylamine, 3,4,3',4' -tetramethoxytriphenylamine, 2,4,4',4"-tetramethoxytriphenylamine, 3,4,4',4"-tetramethoxytriphenylamine, 4,4' -dimethoxy-3",4"-methylenedioxytriphenylamine, 3,4,5,3',4',5' -hexamethoxytriphenylamine, 2,4,2'4',2",4"-hexamethoxytriphenylamine, 3,4,3',4',3",4"-hexamethoxytriphenylamine, 4,4',4,"-trimethoxy-3-methyltriphenylamine, 4,4',4" -trimethoxy-2-methyltriphenylamine, 4,4'-dimethoxy-4"-ethoxytriphenylamine, 4,4'-dimethoxy-4"-propoxytriphenylamine, 4,4'-dimethoxy-4"-n-butoxytriphenylamine, 4,4'-dimethoxy-4"-isobutyloxytriphenylamine, 4,4'-dimethoxy-4"-sec-butyloxytriphenylamine, 4,4'-dimethoxy-4"-pentyloxytriphenylamine, 4,4,-dimethoxy-4"-n-hexyloxytriphenylamine, 4,4,-dimethoxy-4"-n-octyloxytriphenylamine, 4,4'-dimethoxy-4"-(2-ethylhexyloxy)triphenylamine, 4,4' -dimethoxy-4"-n-nonyloxytriphenylamine, 4,4'-dimethoxy-4" -n-decyloxytriphenylamine, 4,4'-dimethoxy-4"-n-dodecyloxytriphenylamine, 4,4-'-dimethoxy-4"-n-octadecyloxytriphenylamine, 4,4'-dimethoxy-4"-phenoxytriphenylamine, 4,4' -dimethoxy-4"-(2-methoxyethoxy)triphenylamine, 4,4'-dimethoxy- 4"-(2-ethoxyethoxy)triphenylamine, 4,4'-dimethoxy-4"-[2-(2 -methoxyethoxy)ethoxy]triphenylamine, 4,4'-dimethoxy-4"-(2 -phenoxyethoxy)triphenylamine, 4-methoxy-4'-phenoxytriphenylamine, 4,4'-dimethoxy-4"-methylthiotriphenylamine, 4,4'-dimethoxy-4"-ethylthiotriphenylamine, 4,4'-dimethoxy-4" -n-butylthiotriphenylamine, 4,4,-dimethoxy-4"-n-decylthiotriphenylamine, 4,4,-dimethoxy-4"-phenylthiotriphenylamine, 4-methoxy-4'-methylthiotriphenylamine, 4-ethylthio-4' -methoxytriphenylamine, 4-n-butylthio-4'-methoxytriphenylamine, 4-n-dodecylthio-4'-methoxytriphenylamine, 4 -methoxy-4'-phenylthiotriphenylamine, 4-methoxy-4'4" -dimethylthiotriphenylamine, 4-methoxy-4',4"-diphenylthiotriphenylamine, 4-methoxy-4',4"-diphenoxytriphenylamine, 4,4'-diethoxy-4"-methoxytriphenylamine, 4,4'-di-n-butoxy-4" -methoxytriphenylamine, 4,4'-di-n-octyloxy-4"-methoxytriphenylamine, 4,4,-di(2-ethylhexyloxy)-4"-methoxytriphenylamine, 4,4',4"-triphenoxytriphenylamine, 4,4',4" -triethoxytriphenylamine, 4,4',4"-tri-n-propoxytriphenylamine, 4,4',4"-tri-n-butoxytriphenylamine, 4-ethoxy-4'-methoxy-4" -methyltriphenylamine, 4-methoxy-4'-ethoxy-4"-propoxytriphenylamine, 4-methoxy-4'-ethoxy-4"-phenoxytriphenylamine, 2',4,4'-trimethoxy-2-methyltriphenylamine, 3',4,4' -trimethoxy-2-methyltriphenylamine, 4-ethoxy-4'-methoxy-2 -methyltriphenylamine, 4-methoxy-2-methyl-4'-propoxytriphenylamine, 4-n-butoxy-4'-methoxy-2-methyltriphenylamine, 4-isobutyloxy-4'-methoxy-2-methyltriphenylamine, 4-methoxy-2 -methyl-4'-pentyloxytriphenylamine, 4-n-hexyloxy-4'-methoxy-2 -methyltriphenylamine, 4-methoxy-4'-n-octyloxy-2-methyltriphenylamine, 4-(2-ethylhexyloxy)-4'-methoxy-2-methyltriphenylamine, 4-n-dodecyloxy-4'-methoxy-2-methyltriphenylamine, 4-(2-ethoxyethoxy)-4'-methoxy-2-methyltriphenylamine, 2,4,4'-trimethoxytriphenylamine, 2,2',4,4',4"-pentamethoxytriphenylamine, N,N,N',N' tetraphenyl-p-phenylenediamine, N,N,N',N'-tetratolyl-p-phenylenediamine, N,N,N',N'-tetrakis(4-methoxyphenyl)-p-phenylenediamine, N,N'-diphenyl-N,N'-ditolyl-p-phenylenediamine, N,N'-diphenyl-N,N'-bis(4-methoxyphenyl)-p-phenylenediamine, N,N,N',N'-tetratolyl-m-phenylenediamine, N,N,N',N'-tetrakis(4-methoxyphenyl)-m-phenylenediamine, 4,4' -dimethoxyphenyl-1"-naphthylamine, 4-methoxyphenyl-4' -methylphenyl-1"-naphthylamine, 4-methoxydiphenyl-1' -naphthylamine, 4,4'-dimethoxyphenyl-4"-methoxy-1" -naphthylamine, 4,4'-dimethoxyphenyl-7"-methoxy-1" -naphthylamine, 4,4'-dimethoxyphenyl-2"-naphthylamine, 4 -methoxyphenyl-4'-methylphenyl-2"-naphthylamine, 4 -methoxydiphenyl-2'-naphthylamine, 2-anthryl-4',4" -dimethoxyphenylamine, 9,10-dihydro-10-p-methoxyphenylacridine, 9,10-dihydro-9,9-dimethyl-10-p-methoxyphenylacridine, 10-p-methoxyphenylphenoxazine, 10-p-methoxyphenylphenothiazine, N-p-methoxyphenyliminodibenzyl, and N-p-methoxyphenyliminostilbene.

The triarylamine derivative represented by general formula (3) will be described below in detail.

In general formula (3) given hereinabove, $Ar^5$, $Ar^9$, $Ar^{10}$ and $Ar^{11}$ each preferably is a phenyl, naphthyl or an anthryl group, especially a phenyl group. These groups may have a substituent.

In the case where $Ar^8$, $Ar^9$, $Ar^{10}$ and $Ar^{11}$ in general formula (3) each are an aryl group substituted by an alkyl, alkoxy or aryloxy group, preferred examples of the substituent include alkyl groups having 1 to 10 carbon atoms, alkoxy groups having 1 to 30 carbon atoms, and aryloxy groups having 6 to 20 carbon atoms. Especially preferred of these are alkyl groups having 1 to 6 carbon atoms, alkoxy groups having 1 to 20 carbon atoms, and aryloxy groups having 6 to 15 carbon atoms. These substituents also may have a substituent. Such the substituents of the groups $Ar^8$ to $Ar^{11}$ are preferably at the position para to the nitrogen of the triphenylamine.

The group

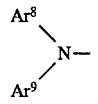

and the group

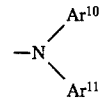

are preferably at a position para or meta to each other.

Preferred examples of $Ar^8$, $Ar^9$, $Ar^{10}$ and $Ar^{11}$ include phenyl, naphthyl, tolyl, ethylphenyl, isopropylphenyl, n-butylphenyl, n-hexylphenyl, n-octylphenyl, methoxyphenyl, ethoxyphenyl, n-propoxyphenyl, isopropoxyphenyl, n-butoxyphenyl, isobutyloxyphenyl, sec-butyloxyphenyl, n-pentyloxyphenyl, isopentyloxyphenyl, n-hexyloxyphenyl, n-octyloxyphenyl, (2-ethylhexyl)phenyl, n-nonyloxyphenyl, n-decyloxyphenyl, n-dodecyloxyphenyl, n-octadecyloxyphenyl, phenoxyphenyl.

In the case where $Ar^8$, $Ar^9$, $Ar^{10}$ and $Ar^{11}$ in general formula (3) are bonded to each other to form a condensed ring having a hetero atom or a double bond, preferred examples of the condensed ring are as follows.

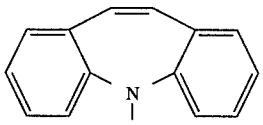

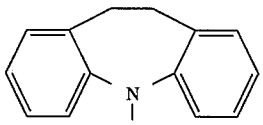

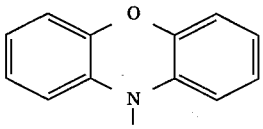

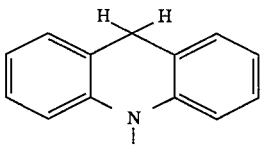

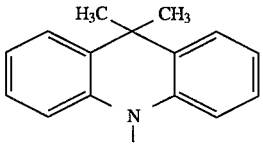

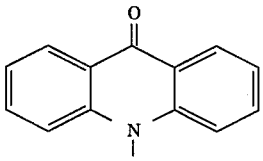

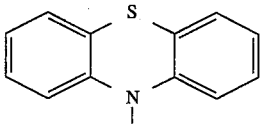

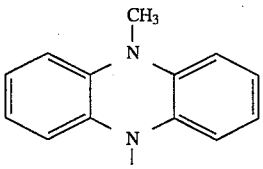

-continued

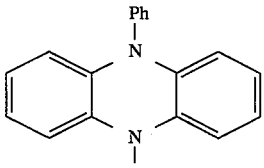

The triarylamine derivative represented by general formula (4) will be described below in detail.

In general formula (4) above, $Ar^{12}$, $Ar^{13}$, $Ar^{14}$ and $Ar^{15}$ each preferably is phenyl, naphthyl, or anthryl group, especially phenyl group. These groups also may have a substituent.

In the case where $Ar^{12}$ $Ar^{13}$ $Ar^{14}$ and $Ar^{15}$ in general formula (4) above are substituted aryl groups, the substituents may be identical or may include two or more different ones. Preferred examples of the substituents include alkyl groups having 1 to 30 carbon atoms, alkenyl groups having 2 to 20 carbon atoms, alkynyl groups having 2 to 20 carbon atoms, aryl groups having 6 to 20 carbon atoms, alkoxy groups having 1 to 30 carbon atoms, aryloxy groups having 6 to 20 carbon atoms, alkylthio groups having 1 to 30 carbon atoms, and arylthio groups having 6 to 20 carbon atoms. These substituents also may be substituted by an alkyl group, an alkoxy group, an aryl group, or an aryloxy group.

Especially preferred examples of the substituents, in the case where $Ar^{12}$, $Ar^{13}$, $Ar^{14}$, and $Ar^{15}$ in general formula (4) are substituted aryl groups, include alkyl groups having 1 to 20 carbon atoms, alkenyl groups having 2 to 10 carbon atoms, alkynyl groups having 2 to 10 carbon atoms, aryl groups having 6 to 15 carbon atoms, alkoxy groups having 1 to 20 carbon atoms, aryloxy groups having 6 to 15 carbon atoms, alkylthio groups having 1 to 20 carbon atoms, and arylthio groups having 6 to 15 carbon atoms.

Preferred specific examples of $Ar^{12}$, $Ar^{13}$, $Ar^{14}$, and $Ar^{15}$ include phenyl, naphthyl, anthryl, tolyl, ethylphenyl, isopropylphenyl, n-butylphenyl, n-hexylphenyl, methoxyphenyl, ethoxyphenyl, n-propoxyphenyl, isopropoxyphenyl, n-butoxyphenyl, isobutyloxyphenyl, sec-butyloxyphenyl, n-pentyloxyphenyl, isopentyloxyphenyl, n-hexyloxyphenyl, n-octyloxyphenyl, (2-ethylhexyl)phenyl, n-nonyloxyphenyl, n-decyloxyphenyl, n-dodecyloxyphenyl, n-octadecyloxyphenyl, phenylphenyl, phenoxyphenyl, (4-methoxyphenoxy)phenyl, (2-methoxyethoxy)phenyl, [2-(2-methoxyethoxy)ethoxy]phenyl, methylthiophenyl, ethylthiophenyl, n-butylthiophenyl, n-decylthiophenyl, phenylthiophenyl, dimethylphenyl, trimethylphenyl, dimethoxyphenyl, trimethoxyphenyl, methylenedioxyphenyl, methoxytolyl, and methoxydimethylphenyl.

It is preferred that in general formula (4) given above X' represents the oxygen atom, the sulfur atom or the bivalent linking group represented by general formula (b) or (c) in which m, n, p or q each represents an integer of 0. It is especially preferred that X' represents the oxygen atom or the sulfur atom.

The oxygen atom, the sulfur atom or the bivalent linking group represented by X' is preferably at a position meta or para to the nitrogen atom. In the case where X' is at the position meta to the two nitrogen atoms, at least one of the substituent of the aryl groups $Ar^{12}$, $Ar^{13}$, $Ar^{14}$ and $Ar^{15}$ be an alkoxy, aryloxy, alkylthio, or arylthio group bonded at the position para to the nitrogen atom. In the case where X' is at the position para to the nitrogen atom, the substituents of the aryl groups $Ar^{12}$, $Ar^{13}$, $Ar^{14}$ and $Ar^{15}$ each is preferably at the position meta or para to the nitrogen atom.

In general formula (4) given above, the bivalent linking group represented by X' may further have a substituent.

Specific examples of the triarylamine derivative represented by general formula (4) according to the present invention are given below, but these compounds are not construed to be limiting the scope of the invention.

The examples include bis(p-diphenylaminophenyl) ether, bis[p-di(p-tolyl)aminophenyl]ether, bis[p-di(m-tolyl)aminophenyl]ether, bis[p-di (p-ethylphenyl)aminophenyl] ether, bis[p-di(p-octylphenyl)aminophenyl]ether, bis[p-di(p-dodecylphenyl)aminophenyl] ether, bis[p-bis(p-methoxyphenyl)aminophenyl] ether, bis[p-bis(m-methoxyphenyl)aminophenyl] ether, bis[p-bis(p-ethoxyphenyl)aminophenyl] ether, bis[p-bis(p-n-butyloxyphenyl)aminophenyl] ether, bis [p-bis(p-n-octyloxyphenyl)aminophenyl] ether, bis[p-bis(p-2-ethylhexyloxyphenyl)aminophenyl] ether, bis[p-bis(p-n-octadecyloxyphenyl)aminophenyl] ether, bis[p-[N-phenyl-N-(p-tolyl)amino] phenyl]ether, bis[p-[N-phenyl-N-(p-methoxyphenyl)amino] phenyl]ether, bis[p-[N-(p-methoxyphenyl)-N-(p-tolyl)amino] phenyl]ether, bis[p-[N-phenyl-N-(m-tolyl)amino] phenyl]ether, bis[p-[N-phenyl-N-(m-methoxyphenyl)amino] phenyl]ether, bis[p-[N-(m-methoxyphenyl)-N-(m-tolyl)amino] phenyl]ether, bis[p-[N-(p-methoxyphenyl)-N-(m-tolyl)amino] phenyl]ether, bis[p-[N-(m-methoxyphenyl)-N-(p-tolyl)amino] phenyl]ether, bis(m-diphenylaminophenyl) ether, bis[m-di(p-tolyl)aminophenyl]ether, bis[m-bis(p-methoxyphenyl)aminophenyl] ether, m-diphenylaminophenyl-p-diphenylaminophenyl ether, m-di(p-tolyl)aminophenyl-p-di(p-tolyl)aminophenyl ether, m-bis(p-methoxyphenyl)aminophenyl-p-bis(p-methoxyphenyl)aminophenyl ether, bis[p-bis(p-phenoxyphenyl)aminophenyl] ether, bis[p-bis(p-methylthiophenyl)aminophenyl] ether, bis[p-bis(p-phenylthiophenyl)aminophenyl] ether, bis(p-diphenylaminophenyl)sulfide, bis[p-di(p-tolyl)aminophenyl]sulfide, bis[p-di(p-ethylphenyl)aminophenyl] sulfide, bis[p-bis(p-methoxyphenyl)aminophenyl]sulfide, bis[p-bis(p-ethoxyphenyl)aminophenyl]sulfide, bis[p-[ N-phenyl-N-(p-tolyl)amino]phenyl]sulfide, bis[p-N-phenyl-N-(p-methoxyphenyl)amino] phenyl]sulfide, bis[p-[N-(p-methoxyphenyl)-N-(p-tolyl)amino] phenyl]sulfide, bis[m-bis(p-methoxyphenyl)aminophenyl] sulfide, m-di(p-tolyl)aminophenyl-p-di(p-tolyl)aminophenyl sulfide, m-bis(p-methoxyphenyl)aminophenyl-p-bis(p-methoxyphenyl)aminophenyl sulfide, 1,2-bis[p-bis(p-methoxyphenyl)aminophenyl]ethane, 2,2-bis[ p-bis(p-methoxyphenyl)aminophenyl]propane, 1,2-bis(p-diphenylaminophenyl)ethylene, 1,2-bis[p-di(p-tolyl)aminophenyl] ethylene, 1,2-bis[p-bis(p-methoxyphenyl)aminophenyl] ethylene, 1,2-bis[p-[N-phenyl-N-(p-methoxyphenyl)amino] phenyl]ethylene, 1,2-bis[p-[N-(p-methoxyphenyl)-N-(p-tolyl)amino] phenyl] ethylene, 1,2-bis[p-[N-phenyl-N-(m-methoxyphenyl)amino] phenyl]ethylene, 1,2-bis[m-di(p-tolyl)aminophenyl] ethylene, 1-m-bis(p-methoxyphenyl)aminophenyl-2-p-bis(p-methoxyphenyl)aminophenyl ethylene, bis(p-diphenylaminophenyl)acetylene, bis[p-di(p-tolyl)aminophenyl] acetylene, bis[p-bis(p-methoxyphenyl)aminophenyl] acetylene, bis[p-bis(m-methoxyphenyl)aminophenyl] acetylene, bis[p-[N-phenyl-N-(p-methoxyphenyl)amino] phenyl]acetylene, and bis[p-[N-(p-methoxyphenyl)-N-(p-tolyl)amino] phenyl]acetylene.

It is preferred that the triarylamine derivative according to the present invention have an oxidation potential lower than that of triphenylamine. The oxidation potential herein means the primary oxidation potential as measured in an acetonitrile solution (concentration, 0.1 mol) of tetraethylammonium perchlorate ($Et_4N^+ClO_4^-$) with a polarographic analyzer (P-1100, manufactured by Yanaco) employing a rotational platinum electrode and a saturated calomel electrode as a reference electrode. The oxidation potential of triphenylamine thus determined is 0.92 V (average of ten times), which coincides with the value in the literature (E.T. SeO et al., *J. Am. Chem. Soc.*, 88, 3498 (1966)).

From the standpoint of lightfastness of images, it is preferred that the triarylamine derivative according to the present invention have a lower oxidation potential. On the other hand, from the standpoint of the oxidation resistance of the triarylamine derivative itself, it is preferred that its oxidation potential not be too low. Specifically, the oxidation potential of the triarylamine derivatives represented by general formulae (1) and (4) according to the present invention is preferably in the range of from 0.25 V to 0.92 V, particularly from 0.40 V to 0.90 V. Further, the oxidation potential of the triarylamine derivatives represented by general formulae (2) and (3) is preferably in the range of from 0.25 V to 0.85 V, particularly from 0.40 V to 0.80 V.

The oxidation potentials of the examples of the triarylamine derivative represented by general formula (1) according to the present invention are as follows.

1,2-bis[p-Diphenylaminophenoxy]ethane (0.84 V), 1,2-bis[p-bis(p-tolylamino)phenoxy]ethane (0.71 V), 1,2-bis[ p-bis (p-methoxyphenylamino) phenoxy]ethane (0.57 V), 1,2-bis[ p-bis(p-methoxyphenylamino)phenoxy]propane (0.57 V), 1,4-bis[ p-bis (p-methoxyphenylamino)phenoxy] butane (0.58 V), 1,2-bis[ p-[N-(p-methoxyphenyl)-N-phenylamino]phenoxy]ethane (o.65 v), 1,2-bis[m-bis(p-methoxyphenylamino)phenoxy]ethane (0.67 V), 1,4-bis[p-bis(p-methoxyphenylamino)phenoxy]benzene (0.54 v), 1,3-bis[p-bis(p-methoxyphenylamino)phenoxy]benzene (0.57 v), 4,4'-bis[p-bis(p-methoxyphenylamino)phenoxy]biphenyl (0.58 V), α,α'-bis[p-bis(p-methoxyphenylamino)phenoxy]-p-xylene (0.57 V), bis[4-(p-diphenylaminophenoxy)phenyl]ether (0.82 V), bis[4-[bis(p-methoxyphenylamino)phenoxy]ethyl] ether (0.57 V), 2,2-bis[4-[bis(p-methoxyphenylamino)phenoxy] phenyl]propane (0.57 V), 2,2-bis[4-[ bis(p-methoxyphenylamino)phenoxy]phenyl]hexafluoropropane (0.60 V), and 1,2 -bis[4-[bis(p-methoxyphenylamino)phenoxy] carbonyl]ethane (0.67 V).

Also, the oxidation potentials of the examples of the triarylamine derivatives represented by general formulae (2) and (3) according to the present invention are as follows.

4-Methoxytriphenylamine (0.76 V), 4,4'-dimethoxytriphenylamine (0.63 V), 4,4',4"-trimethoxytriphenylamine (0.52 V), 4,4,-dimethoxy-4"-n-octyloxytriphenylamine (0.54 V), 4,4,-dimethoxy-4"-methyltriphenylamine (0.64 V), 4,4'-dimethoxy-4"-methylthiotriphenylamine (0.56 V), 2,4',4"-trimethoxytriphenylamine (0.61 V), 2,2',4"-trimethoxytriphenylamine (0.67 V), 2,4,4',4"-tetramethoxytriphenylamine (0.52 V), 3,4,4',4.-tetramethoxytriphenylamine (0.52 V), 4,4,-dimethoxy-4"-phenoxytriphenylamine (0.57 V), N,N,N',N' -tetraphenyl-m-phenylenediamine (0.52 V), N,N,N',N'-tetrakis( 4-methoxyphenyl)-p-phenylenediamine (0.42 V), N,N'-diphenyl-N,N' -ditolyl-p-phenylenediamine (0.47 V), 4-n-dodecyloxytriphenylamine (0.78 V), 10-p-methoxyphenylphenoxazine (0.64 V), N-p-methoxyiminostilbene (0.72 V), and 1-naphthyl-4',4"-dimethoxytriphenylamine (0.66 V).

Further, the oxidation potentials of the examples of the triarylamino derivative represented by general formula (4) according to the present invention are as follows.

Bis(p-diphenylaminophenyl) ether (0.81 V), bis[p-di(p-tolyl)aminophenyl] ether (0.73 V), bis[p-bis(p-ether (0.60 V), bis[p-bis(m-methoxyphenyl)aminophenyl] methoxyphenyl)aminophenyl]ether (0.61 V), bis [p-bis(p-ethoxyphenyl)aminophenyl] ether (0.59 V), bis[p-[N-(p-methoxyphenyl)-N-(p-tolyl)amino] phenyl]ether (0.61 V), bis[p-

['N-(m-methoxyphenyl)-N-(p-tolyl)amino]phenyl]ether (0.63 V), bis[m-bis(p-methoxyphenyl)aminophenyl]ether (0.59 V), m-di(p-tolyl)aminophenyl-p-di(p-tolyl)aminophenyl ether (0.64 V), m-bis(p-methoxyphenyl)aminophenyl-P-bis(P-methoxyphenyl)aminophenyl ether (0.60 V), bis[p-bis(p-methoxyphenyl)aminophenyl] sulfide (0.59 V), bis[p-bis(p-ethoxyphenyl)aminophenyl] sulfide (0.59 V), bis[p-[N-phenyl-N-(p-tolyl)amino] phenyl]sulfide (0.74 V), bis[p-[N-phenyl-N-(p-methoxyphenyl)amino] phenyl]sulfide (0.69 V), bis[p-[N-(p-methoxyphenyl)-N-(p-tolyl)amino] phenyl]sulfide (0.60 V), m-bis(p-methoxyphenyl)aminophenyl-p-bis(p-methoxyphenyl)aminophenyl sulfide (0.59 V), 1,2-bis[p-bis(p-methoxyphenyl)aminophenyl] ethylene (0.63 V), 1,2-bis[p-[N-(p-methoxyphenyl)-N-(p-tolyl)amino] phenyl]ethylene (0.66 V), 1,2-bis[p-[ N-phenyl-N-(m-methoxyphenyl)amino]phenyl]ethylene (0.71 V), 1,2-bis(p-diphenylaminophenyl)acetylene (0.84 V), and 1,2-bis[ p-bis(p-methoxyphenyl)aminophenyl]acetylene (0.66 V).

The triarylamine derivatives according to the present invention may be used alone or in combination of two or more thereof.

The triarylamine derivative according to the present invention may be used in combination with a conventionally known ultraviolet absorber, fluorescent brightener, and antioxidant.

Preferred ultraviolet absorbers that can be used in combination with the triarylamine derivatives according to the present invention include benzophenone type ultraviolet absorbers, benzotriazole type ultraviolet absorbers, salicylic acid type ultraviolet absorbers, cyanoacrylate type ultraviolet absorbers, oxalic acid anilide type ultraviolet absorbers, and the like. Examples of these are given in, e.g., JP-A-47-10537, JP-A-58-111942, JP-A-58-212844, JP-A-59 -19945, JP-A-59-46646, JP-A-59-109055, JP-A-63-53544, JP-B-36 -10466, JP-B-42-26187, JP-B-48-30492, JP-B-48-31255, JP-B-48 -41572, JP-B-48-54965, JP-B-50-10726, U.S. Pat. Nos. 2,719,086, 3,707,375, 3,754,919, and 4,220,711.

Preferred fluorescent brighteners that can be used in combination with the triarylamine derivative of the present invention include coumarin type fluorescent brighteners and the like. Examples of these are given in, e.g., JP-B-45-4699 and JP-B-54-5324.

Preferred antioxidants that can be used in combination with the triarylamine derivative of the present invention include hindered amine type antioxidants, hindered phenol type antioxidants, aniline type antioxidants, quinoline type antioxidants, and the like. Examples of these are given in, e.g., JP-A-59-155090, JP-A-60-107383, JP-A-60 -107384, JP-A-61-137770, JP-A-61-139481, and JP-A-61-160287.

The electron-donating achromatic dye according to the present invention can be conventionally known various compounds such as triphenylmethane phthalide compounds, fluoran compounds, phenothiazine compounds, indolylphthalide compounds, leucoauramine compounds, rhodamine lactam compounds, triphenylmethane compounds, triazene compounds, spiropyran compounds, and fluorene compounds. Specific examples of the phthalide compounds are given in U.S. Pat. No. Re. 23,024 and U.S. Pat. Nos. 3,491,111, 3,491,112, 3,491,116, and 3,509,174; examples of the fluoran compounds are given in U.S. Pat. Nos. 3,624,107, 3,627,787, 3,641,011, 3,462,828, 3,681,390, 3,920,510, and 3,959,571; examples of the spirodipyran compounds are given in U.S. Pat. No. 3,971,808; examples of pyridine compounds and pyrazine compounds are given in U.S. Pat. Nos. 3,775,424, 3,853,869, and 4,246,318; and examples of the fluorene compounds are given in JP-A-63-94878.

Examples of the electron-accepting compound to be used in the recording material of the present invention include phenol derivatives, salicylic acid derivatives, metal salts of aromatic carboxylic acids, acid clay, bentonite, novolak resins, metal-treated novolak resins, and metal complexes.

Specific examples of these compounds are given in, e.g., JP-B-40-9309, JP-B-45-14039, JP-A-52-140483, JP-A-48 -51510, JP-A-57-210886, JP-A-58-87089, JP-A-59-11286, JP-A-60 -176795, and JP-A-61-95988.

In the case where the recording material of the present invention is a pressure-sensitive copying paper, it can have various constitutions such as those described in prior art patents including U.S. Pat. Nos. 2,505,470, 2,505,471, 2,505,489, 2,548,366, 2,712,507, 2,730,456, 2,730,457, 3,103,404, 3,418,250, and 4,010,038. The most common is a constitution consisting of at least a pair of sheets separately containing an electron-donating achromatic dye and an electron-accepting compound.

Exemplary techniques for capsule production include the method utilizing the coacervation of a hydrophilic colloidal sol as described in U.S. Pat. Nos. 2,800,457 and 2,800,458; the interfacial polymerization method described in, e.g., U.S. Patent 3,287,154, British Patents 867,797, 950,443, 989,264, 990,443, and 1,091,076, JP-B-38-19574, JP-B-42-446, and JP-B-42-771; the method based on polymer precipitation as described in U.S. Pat. Nos. 3,418,250 and 3,660,304; the method using an isocyanate-polyol wall material as described in U.S. Patent 3,418,250; the method using an isocyanate wall material as described in U.S. Patent 3,914,511; the method using a urea-formaldehyde or urea-formaldehyde-resorcinol wall material and using a melamine-formaldehyde resin, hydroxypropyl cellulose, or the like as a wall-forming material as described in U.S. Pat. Nos. 4,001,140, 4,087,376, and 4,089,802; the in-situ encapsulation method based on monomer polymerization as described in JP-B-36-9168 and JP-A-51-9079; the method based on electrolysis, dispersion, and cooling as described in British Pat. Nos. 952,807 and 965,074; and the spray drying method described in U.S. Patent 3,111,407 and British Patent 930,422. Although the encapsulation technique is not limited to these, it is preferred to emulsify a core material before the formation of a polymer layer as microcapsule walls.

In general, a color former sheet is obtained by mixing an electron-donating achromatic dye with the triarylamine derivative of the present invention, dissolving the mixture into a solvent (e.g., a synthetic oil such as an alkylated naphthalene, alkylated diphenyl, alkylated diphenylmethane, alkylated terphenyl, or chlorinated paraffin, a vegetable oil such as cotton oil or castor oil, an animal oil, a mineral oil, or a mixture thereof), microencapsulating the solution, and applying the resulting fluid on a paper, woodfree paper, plastic sheet, resin-coated paper, etc.

A developer sheet is obtained by dispersing an electron-accepting compound into a binder such as a styrene-butadiene latex or poly(vinyl alcohol), if necessary along with one or more additives, and applying the resulting fluid on a substrate such as a paper, plastic sheet, or resin-coated paper along with a pigment.

A combination of a carboxylated styrene-butadiene latex and a water-soluble polymer is preferred as the binder from the standpoints of light resistance and water resistance. A preferred pigment from the standpoint of color-developing ability is one which comprises calcium carbonate with an average particle diameter of 5.0 μm or below in an amount of at least 60% by weight based on the amount of all the pigment.

The amounts of the electron-donating achromatic dye and electron-accepting compound to be used vary depending on the desired coating thickness, constitution of the pressure-sensitive copying paper, capsule production method, and other conditions. The amounts thereof may, therefore, be suitably selected according to these considerations, which selection is easy to one skilled in the art.

In the case where the recording material of the present invention is a heat-sensitive recording paper, it has a constitution such as that described in, e.g., JP-A-62- 144989 and JP-A-1-87291. Illustratively stated, an electron-donating achromatic dye and an electron-accepting compound are ground and dispersed in a dispersion medium to particle diameters of 10 μm or below, preferably 3 μm or below, before they are used. As the dispersion medium, an aqueous solution of a water-soluble polymer is generally used which has a concentration of about from 0.5 to 10%. The dispersion is conducted with, e.g., a ball mill, sand mill, horizontal sand mill, attritor, or colloid mill.

The proportion of the triarylamine derivative to electron-donating achromatic dye to be used is preferably between 0.01:1 and 20:1 by weight, especially between 0.1:1 and 10:1 by weight.

The proportion of the electron-donating achromatic dye to electron-accepting compound is preferably between 1:10 and 1:1 by weight, especially between 1:5 and 2:3 by weight.

In order to improve response to heat, a heat-fusible substance may be incorporated into the thermally color-forming layer. Representative examples of the heat-fusible substance include aromatic ethers, thioethers, esters, and/or aliphatic amides or ureides.

Specific examples of these heat-fusible substances are given in, e.g., JP-A-58-57989, JP-A-58-87094, JP-A-61 -58789, JP-A-62-109681, JP-A-62-132674, JP-A-63-151478, JP-A-63-235961, JP-A-2-184489, and JP-A-2-215585.

These heat-fusible substances are finely ground, before use, along with the electron-donating achromatic dye or with the electron-accepting compound. The amount of these heat-fusible substances to be used is preferably from 20 to 300% by weight, especially from 40 to 150% by weight, based on the amount of the electron-accepting compound.

To the coating fluid thus obtained, additives are added if desired and necessary in order to meet various requirements. For example, an oil-absorbing substance such as an inorganic pigment or a polyurea filler is dispersed beforehand into the binder in order to prevent the smearing of a recording head during recording, while a fatty acid, a metal soap, or the like is added in order to enhance head releasability. Hence, additives such as a heat-fusible substance, a pigment, a wax, an antistatic agent, an ultraviolet absorber, an anti-foaming agent, a conducting agent, a fluorescent dye, and a surfactant are generally applied on a substrate besides the electron-donating achromatic dye and electron-accepting compound which directly contribute to color development, thereby giving a recording material. A protective layer may be further formed on the surface of the heat-sensitive recording layer if desired and necessary.

The electron-donating achromatic dye, the electron-accepting compound, and the triarylamine derivative characteristic of the present invention are usually applied in the form of a dispersion in a binder. A water-soluble binder is generally employed. Examples thereof include poly(vinyl alcohol), hydroxyethyl cellulose, hydroxypropyl cellulose, epichlorohydrin-modified polyamides, ethylene-maleic anhydride copolymers, styrene-maleic anhydride copolymers, isobutylene-maleic anhydride-salicylic acid copolymers, poly(acrylic acid), polyacrylamide, methylol-modified polyacrylamide, starch derivatives, casein, and gelatin. For the purpose of imparting water resistance to these binders, a water resistance imparter or a hydrophobic polymer emulsion, e.g., a styrene-butadiene rubber latex or an acrylic resin emulsion, may be added.

The heat-sensitive coating fluid obtained is applied on a fine-quality paper, primed fine-quality paper, synthetic paper, plastic film, or the like. Especially preferred as this substrate from the standpoint of dot reproduction is one having a smoothness as determined in accordance with JIS-8119 of 500 seconds or higher, especially 800 seconds or higher.

The triarylamine derivative according to the present invention is applicable to various recording materials described in U.S. Pat. Nos. 4,399,209, 4,551,407, 4,440,846, and 4,536,463, JP-A-63-184738, JP-A-58-88739, JP-A-62-143044, JP-A-2-188293, JP-A-2-188294, JP-A-3-72358, JP-A-3-87827, JP-A-4-226455, JP-A-4-247985, JP-A-5-124360, and JP-A-5-294063.

The triarylamine derivatives represented by general formulae (1) to (4) of the present invention are all well known compounds and can be easily synthesized by conventional methods e.g., Organic Synthesis, collective vol. I, 544 (1941).

Examples of the present invention will be given below, but the invention is not construed as being limited thereto. In the examples, all parts and percents are by weight unless otherwise indicated.

EXAMPLE 1

1) Production of Sheet Coated with Capsules Containing Electron-donating Achromatic Dye In 95 parts of water was dissolved 5 parts of a partial sodium salt of poly(vinylbenzenesulfonic acid) (VERSA, TL500; manufactured by National Starch Co.). Aqueous sodium hydroxide solution was added thereto to adjust the pH to 4.0. 100 Parts of diisopropylnaphthalene containing 6.8% 2-anilino-3-methyl-6-di-n-butylaminofluoran dissolved therein as an electron-donating achromatic dye, and 15% 1,2-bis[ p-bis(p-methoxyphenylamino)phenoxy]ethane as the compound of the present invention was emulsified into 100 parts of the 5% aqueous solution of the partial sodium salt of poly(vinylbenzenesulfonic acid) to obtain an emulsion having a particle diameter of 4.0 μm. On the other hand, a mixture of 6 parts of melamine, 11 parts of 37 wt% aqueous formaldehyde solution, and 30 parts of water was stirred with heating at 60° C. to obtain a clear aqueous solution of a melamine-formaldehyde prepolymer. This aqueous solution was mixed with the emulsion obtained above. The pH of the mixture was adjusted to 6.0 with aqueous phosphoric acid solution with stirring, and the resulting liquid was heated to 65° C. and kept being stirred for 6 hours. The capsule dispersion thus obtained was cooled to room temperature and its pH was adjusted to 9.0 with aqueous sodium hydroxide solution.

To this dispersion were added 200 parts of 10% aqueous poly(vinyl alcohol) solution and 50 parts of starch particles. Water was added thereto to prepare a microcapsule dispersion having a solid content of 20%.

This coating fluid was applied on a 50 g/m$^2$ base paper with an air-knife coater in a solid amount of 5 g/m$^2$ on a solid basis, and dried to thereby obtain a sheet coated with capsules containing an electron-donating achromatic dye.

2) Production of Sheet Coated with Electron-accepting Compound

A dispersion consisting of 14 parts of zinc 3,5 -bis(α-methylbenzyl)salicylate, 80 parts of calcium carbonate, 20 parts of zinc oxide, 1 part of sodium hexametaphosphate, and 200 parts of water was treated with a sand grinder to disperse the solid ingredients to an average particle diameter of 3 μm. To this dispersion were added 100 parts of 10% aqueous PVA solution and 10 parts (as a solid amount) of a carboxylated SBR latex. Water was added thereto in such an amount as to result in a solid content of 20% to obtain a coating fluid. This coating fluid was applied on a 50 g/m$^2$ base paper with an air-knife coater in a solid amount of 5.0 g/m$^2$ on a solid basis, and dried to thereby obtain a sheet coated with an electron-accepting compound.

The sheet coated with electron-donating achromatic dye microcapsules was superposed on the sheet coated with an electron-accepting compound in such a manner that the microcapsule-coated side of the former met the latter. Color was developed by applying a load of 300 kg/cm$^2$ to obtain a black image.

EXAMPLE 2

A microcapsule-coated sheet was obtained in the same manner as in Example 1 except that the 1,2-bis[ p-bis(p-methoxyphenylamino)phenoxy]ethane in Example 1 was replaced by 1,2-bis[p-bis(p-tolylamino)phenoxy]ethane in the same amount by weight. Color was developed in the same manner as in Example 1 to obtain a black image.

In the following examples, unless otherwise indicated, such the replacement of the compounds as in Example 2 above was made in the same amount by weight.

EXAMPLE 3

A microcapsule-coated sheet was obtained in the same manner as in Example 1 except that the 1,2-bis[ p-bis(p-methoxyphenylamino)phenoxy]ethane in Example 1 was replaced by 1,2-bis(p-diphenylaminophenoxy)ethane. Color was developed in the same manner as in Example 1 to obtain a black image.

EXAMPLE 4

A microcapsule-coated sheet was obtained in the same manner as in Example 1 except that the 1,2-bis[ p-bis(p-methoxyphenylamino)phenoxy]ethane in Example 1 was replaced by 1,2-bis[p-[N-(p-methoxyphenyl)-N-phenylamino]phenoxy] -ethane. Color was developed in the same manner as in Example 1 to obtain a black image.

EXAMPLE 5

A microcapsule-coated sheet was obtained in the same manner as in Example 1 except that the 1,2-bis[ p-bis(p-methoxyphenylamino)phenoxy]ethane in Example 1 was replaced by 1,4-bis[p-bis(p-methoxyphenylamino)phenoxy] butane. Color was developed in the same manner as in Example 1 to obtain a black image.

EXAMPLE 6

A microcapsule-coated sheet was obtained in the same manner as in Example 1 except that the 1,2-bis[ p-bis(p-methoxyphenylamino)phenoxy]ethane in Example 1 was replaced by 1,2-bis[m-bis(p-methoxyphenylamino)phenoxy]ethane. Color was developed in the same manner as in Example 1 to obtain a black image.

EXAMPLE 7

A microcapsule-coated sheet was obtained in the same manner as in Example 1 except that the 1,2-bis[ p-bis(p-methoxyphenylamino)phenoxy]ethane in Example 1 was replaced by 1,3-bis[p-bis(p-methoxyphenylamino)phenoxy] benzene. Color was developed in the same manner as in Example 1 to obtain a black image.

EXAMPLE 8

A microcapsule-coated sheet was obtained in the same manner as in Example 1 except that the 1,2-bis[ p-bis(p-methoxyphenylamino)phenoxy]ethane in Example 1 was replaced by α,α'-bis[p-bis(p-methoxyphenylamino)phenoxy]-p-xylene. Color was developed in the same manner as in Example 1 to obtain a black image.

EXAMPLE 9

A microcapsule-coated sheet was obtained in the same manner as in Example 1 except that the 1,2-bis[ p-bis(p-methoxyphenylamino)phenoxy]ethane in Example 1 was replaced by 2,2-bis[4-[bis(p-methoxyphenylamino)phenoxy]phenyl] -propane. Color was developed in the same manner as in Example 1 to obtain a black image.

EXAMPLE 10

A microcapsule-coated sheet was obtained in the same manner as in Example 1 except that the 1,2-bis[p-bis(p-methoxyphenylamino)phenoxy] ethane in Example 1 was replaced by 2,2-bis[4-[bis(p-methoxyphenylamino)phenoxy]phenyl] hexafluoropropane. Color was developed in the same manner as in Example 1 to obtain a black image.

EXAMPLE 11

A microcapsule-coated sheet was obtained in the same manner as in Example 1 except that the 1,2-bis[ p-bis(p-methoxyphenylamino)phenoxy]ethane in Example 1 was replaced by bis[4-[bis(p-methoxyphenylamino)phenoxy] ethyl]ether. Color was developed in the same manner as in Example 1 to obtain a black image.

EXAMPLE 12

A microcapsule-coated sheet was obtained in the same manner as in Example 1 except that the 1,2-bis[ p-bis(p-methoxyphenylamino)phenoxy]ethane in Example 1 was replaced by 1,2-bis[4-[bis(p-methoxyphenylamino)phenoxy]carbonyl] -ethane. Color was developed in the same manner as in Example 1 to obtain a black image.

EXAMPLE 13

A microcapsule-coated sheet was obtained in the same manner as in Example 1 except that the 2-anilino-3-methyl-6 -di-n-butylaminofluoran (the electron donating achromatic dye) in Example 1 was replaced by 2-anilino-6-N-ethyl-N-n-hexylaminofluoran. Color was developed in the same manner as in Example 1 to obtain a green image.

EXAMPLE 14

A microcapsule-coated sheet was obtained in the same manner as in Example 1 except that the 2-anilino-3-methyl-6-di-n-butylaminofluoran in Example 1 was replaced by 3,3-bis( 4-dimethylaminophenyl)-6-dimethylaminophthalide (crystal violet lactone). Color was developed in the same manner as in Example 1 to obtain a blue image.

EXAMPLE 15

A microcapsule-coated sheet was obtained in the same manner as in Example 1 except that the 2-anilino-3-methyl-6-di-n-butylaminofluoran in Example 1 was replaced by 3-(4-diethylamino-2-ethoxyphenyl)-3-(1-n-octyl-2-methylindol-3 -yl)phthalide. Color was developed in the same manner as in Example 1 to obtain a blue image.

EXAMPLE 16

A microcapsule-coated sheet was obtained in the same manner as in Example 1 except that the 2-anilino-3-methyl-6-di-n-butylaminofluoran in Example 1 was replaced by 3,3-bis( 1-n-octyl-2-methylindol-3-yl)phthalide. Color was developed in the same manner as in Example 1 to obtain a red image.

EXAMPLE 17

A microcapsule-coated sheet was obtained in the same manner as in Example 1 except that the 2-anilino-3-methyl-6-di-n-butylaminofluoran in Example 1 was replaced by 3-[1-bis(4-diethylaminophenyl)ethylene-2-yl]-6-dimethylaminophthalide. Color was developed in the same manner as in Example 1 to obtain a cyan image.

EXAMPLE 18

A microcapsule-coated sheet was obtained in the same manner as in Example 1 except that the 2-anilino-3-methyl-6-di-n-butylaminofluoran in Example 1 was replaced by 3,6-bis(dimethylamino)fluorene-9-spiro-3'-(6'-dimethylamino)phthalide. Color was developed in the same manner as in Example 1 to obtain a blue-green image.

EXAMPLE 19

A microcapsule-coated sheet was obtained in the same manner as in Example 1 except that the 2-anilino-3-methyl-6-di-n-butylaminofluoran in Example 1 was replaced by 3-diethylamino-7,8-benzofluoran. Color was developed in the same manner as in Example 1 to obtain a red image.

EXAMPLE 20

A microcapsule-coated sheet was obtained in the same manner as in Example 1 except that the 2-anilino-3-methyl-6-di-n-butylaminofluoran in Example 1 was replaced by 3,3-bis(4-diethylamino-2-methylphenyl)-4,7-diazaphthalide. Color was developed in the same manner as in Example 1 to obtain a green image.

EXAMPLE 21

A microcapsule-coated sheet was obtained in the same manner as in Example 1 except that the 2-anilino-3-methyl-6-di-n-butylaminofluoran in Example 1 was replaced by 3,3-bis(4-diethylamino-2-ethoxyphenyl)-4-azaphthalide. Color was developed in the same manner as in Example 1 to obtain a cyan image.

EXAMPLE 22

A microcapsule-coated sheet was obtained in the same manner as in Example 1 except that 100 parts of diisopropylnaphthalene containing dissolved therein 5% 1,2-bis[p-bis(p-methoxyphenylamino)phenoxy]ethane and 10% 1,2-bis(p-diphenylaminophenoxy)ethane was used in place of 100 parts of the diisopropylnaphtalene containing dissolved therein 15% 1,2-bis[p-bis(p-methoxyphenylamino)phenoxy]ethane as used in Example 1. Color was developed in the same manner as in Example 1 to obtain a black image.

EXAMPLE 23

A microcapsule-coated sheet was obtained in the same manner as in Example 1 except that 100 parts of diisopropylnaphthalene containing dissolved therein 5% 1,2-bis[p-bis(p-methoxyphenylamino)phenoxy]ethane and 10% o-benzotriazolyl-p-methylphenol was used in place of 100 parts of the diisopropylnaphtalene containing dissolved therein 15% 1,2-bis[p-bis(p-methoxyphenylamino)phenoxy]ethane as used in Example 1. Color was developed in the same manner as in Example 1 to obtain a black image.

EXAMPLE 24

Each of 2-anilino-3-methyl-6-di-n-butylaminofluoran as an electron-donating achromatic dye, bisphenol A as an electron-accepting compound, and 1,2-bis[p-bis(p-methoxyphenylamino)phenoxy] ethane as the compound of the present invention was dispersed in each amount of 20 g into 100 g of a 5% aqueous solution of poly(vinyl alcohol) (Kuraray PVA 105) with a ball mill for a whole day and night to reduce the particles to a volume-average particle diameter of 3 μm. On the other hand, 80 g of calcined kaolin (Anisilex-93) was dispersed into 160 g of a 0.5% solution of sodium hexametaphosphate with a homogenizer.

The dispersions thus prepared were mixed together in such a proportion that the amount of the dispersion of the electron-donating achromatic dye was 5 g, that of the dispersion of the electron-accepting compound 10 g, that of the dispersion of the heat-fusible compound 10 g, and that of the calcined-kaolin dispersion 22 g. Further, 4 g of an emulsion of zinc stearate and 5 g of a 2% aqueous solution of sodium di(2-ethylhexyl)sulfosuccinate were added to the mixture to obtain a coating fluid. This coating fluid was applied on a wood-free paper having a basis weight of 50 $g/m^2$ with a wire-wound bar in a coated solid amount of 6 $g/m^2$ on a basis, and the coating was calendered to thereby obtain a coated paper.

The coated paper thus obtained was subjected to printing with a thermal head (KLT-216-8MPD1) manufactured by Kyocera Corp., Japan to obtain a black image.

EXAMPLE 25

A coated paper was obtained in the same manner as in Example 24 except that the 1,2-bis[ p-bis(p-methoxyphenylamino)phenoxy]ethane in Example 24 was replaced by 1,4-bis[ p-bis(p-methoxyphenylamino)phenoxy]benzene. Color was developed in the same manner as in Example 24 to obtain a black image.

EXAMPLE 26

A coated paper was obtained in the same manner as in Example 24 except that the 1,2-bis[p-bis(p-methoxyphenylamino)phenoxy] ethane in Example 24 was replaced by 4,4'-bis[ p-bis(p-methoxyphenylamino)phenoxy]biphenyl. Color was developed in the same manner as in Example 24 to obtain a black image.

EXAMPLE 27

A coated paper was obtained in the same manner as in Example 24 except that the 1,2-bis[p-bis(p-methoxyphenylamino)phenoxy] ethane in Example 24 was replaced by bis[4-(p-diphenylaminophenoxy)phenyl] ether. Color was developed in the same manner as in Example 24 to obtain a black image.

EXAMPLE 28

A coated paper was obtained in the same manner as in Example 24 except that the 2-anilino-3-methyl-6 -di-n-butylaminofluoran in Example 24 was replaced by 2-(m-trifluoromethylanilino)- 6-diethylaminofluoran. Color was developed in the same manner as in Example 24 to obtain a black image.

EXAMPLE 29

A coated paper was obtained in the same manner as in Example 24 except that the bisphenol A in Example 24 was replaced by 4-isopropyloxyphenyl 4'-hydroxyphenyl sulfone. Color was developed in the same manner as in Example 24 to obtain a black image.

EXAMPLE 30

A coated paper was obtained in the same manner as in Example 24 except that the bisphenol A in Example 24 was replaced by zinc 5-[2-(4-methoxyphenoxy)ethoxy]salicylate. Color was developed in the same manner as in Example 24 to obtain a black image.

EXAMPLE 31

A coated paper was obtained in the same manner as in Example 24 except that the bisphenol A in Example 24 was replaced by zinc 2-phenoxyacetamidobenzoate. Color was developed in the same manner as in Example 24 to obtain a black image.

EXAMPLE 32

A coated paper was obtained in the same manner as in Example 24 except that the bisphenol A in Example 24 was replaced by 1,5-bis(3,5-dihydroxyphenylcarbonyloxy-)pentane. Color was developed in the same manner as in Example 24 to obtain a black image.

COMPARATIVE EXAMPLE 1

A microcapsule-coated sheet was obtained in the same manner as in Example 1 except that the 1,2-bis[p-bis(p-methoxyphenylamino)phenoxy] ethane used in Example 1 was omitted. Color was developed in the same manner as in Example 1 to obtain a black image.

COMPARATIVE EXAMPLE 2

A microcapsule-coated sheet was obtained in the same manner as in Example 1 except that o-benzotriazolyl-p-methylphenol was used in place of the 1,2-bis[p-bis(p-methoxyphenylamino)phenoxy] ethane in Example 1. Color was developed in the same manner as in Example 1 to obtain a black image.

COMPARATIVE EXAMPLE 3

A microcapsule-coated sheet was obtained in the same manner as in Example 13 except that the 1,2-bis[p-bis(p-methoxyphenylamino)phenoxy] ethane used in Example 13 was omitted. Color was developed in the same manner as in Example 13 to obtain a green image.

COMPARATIVE EXAMPLE 4

A microcapsule-coated sheet was obtained in the same manner as in Example 14 except that the 1,2-bis[p-bis(p-methoxyphenylamino)phenoxy] ethane used in Example 14 was omitted. Color was developed in the same manner as in Example 14 to obtain a blue image.

COMPARATIVE EXAMPLE 5

A microcapsule-coated sheet was obtained in the same manner as in Example 15 except that the 1,2-bis[p-bis(p-methoxyphenylamino)phenoxy] ethane used in Example 15 was omitted. Color was developed in the same manner as in Example 15 to obtain a blue image.

COMPARATIVE EXAMPLE 6

A microcapsule-coated sheet was obtained in the same manner as in Example 16 except that the 1,2-bis[p-bis(p-methoxyphenylamino)phenoxy] ethane used in Example 16 was omitted. Color was developed in the same manner as in Example 16 to obtain a red image.

COMPARATIVE EXAMPLE 7

A microcapsule-coated sheet was obtained in the same manner as in Example 17 except that the 1,2-bis[p-bis(p-methoxyphenylamino)phenoxy] ethane used in Example 17 was omitted. Color was developed in the same manner as in Example 17 to obtain a cyan image.

COMPARATIVE EXAMPLE 8

A microcapsule-coated sheet was obtained in the same manner as in Example 18 except that the 1,2-bis[p-bis(p-methoxyphenylamino)phenoxy]ethane used in Example 18 was omitted. Color was developed in the same manner as in Example 18 to obtain a blue-green image.

COMPARATIVE EXAMPLE 9

A microcapsule-coated sheet was obtained in the same manner as in Example 19 except that the 1,2-bis[p-bis(p-methoxyphenylamino)phenoxy] ethane used in Example 19 was omitted. Color was developed in the same manner as in Example 19 to obtain a red image.

COMPARATIVE EXAMPLE 10

A microcapsule-coated sheet was obtained in the same manner as in Example 20 except that the 1,2-bis[p-bis(p-methoxyphenylamino)phenoxy] ethane used in Example 20 was omitted. Color was developed in the same manner as in Example 20 to obtain a green image.

COMPARATIVE EXAMPLE 11

A microcapsule-coated sheet was obtained in the same manner as in Example 21 except that the 1,2-bis[p-bis(p-methoxyphenylamino)phenoxy] ethane used in Example 21 was omitted. Color was developed in the same manner as in Example 21 to obtain a cyan image.

COMPARATIVE EXAMPLE 12

A coated paper was obtained in the same manner as in Example 24 except that the 1,2-bis[p-bis(p-methoxyphenylamino)phenoxy] ethane used in Example 24 was omitted. Color was developed in the same manner as in Example 24 to obtain a black image.

COMPARATIVE EXAMPLE 13

A coated paper was obtained in the same manner as in Example 24 except that o-benzotriazolyl-p-methylphenol was used in place of the 1,2-bis[p-bis(p-methoxyphenylamino)phenoxy] ethane in Example 24. Color was developed in the same manner as in Example 24 to obtain a black image.

COMPARATIVE EXAMPLE 14

A coated paper was obtained in the same manner as in Example 28 except that the 1,2-bis[p-bis(p-methoxyphenylamino)phenoxy] ethane used in Example 28 was omitted. Color was developed in the same manner as in Example 28 to obtain a black image.

COMPARATIVE EXAMPLE 15

A coated paper was obtained in the same manner as in Example 29 except that the 1,2-bis[p-bis(p-methoxyphenylamino)phenoxy] ethane used in Example 29 was omitted. Color was developed in the same manner as in Example 29 to obtain a black image.

COMPARATIVE EXAMPLE 16

A coated paper was obtained in the same manner as in Example 30 except that the 1,2-bis[p-bis(p-methoxyphenylamino)phenoxy] ethane used in Example 30 was omitted. Color was developed in the same manner as in Example 30 to obtain a black image.

COMPARATIVE EXAMPLE 17

A coated paper was obtained in the same manner as in Example 31 except that the 1,2-bis[p-bis(p-methoxyphenylamino)phenoxy] ethane used in Example 31 was omitted. Color was developed in the same manner as in Example 31 to obtain a black image.

COMPARATIVE EXAMPLE 18

A coated paper was obtained in the same manner as in Example 32 except that the 1,2-bis[p-bis(p-methoxyphenylamino)phenoxy] ethane used in Example 32 was omitted. Color was developed in the same manner as in Example 32 to obtain a black image.

The recording materials obtained in Examples 1 to 32 and Comparative Examples 1 to 18 were evaluated for light Fastness as follows.

(Image Light Fastness Test)

The images (color images) obtained in the Examples and the Comparative Examples were irradiated with light using a xenon fadeometer (Type FAL-25AX-HC, manufactured by Suga Shiken-ki K.K., Japan). The irradiation time for Examples 1 to 23 and Comparative Examples 1 to 11 was 4 hours and that for Examples 24 to 32 and Comparative Examples 12 to 18 was 24 hours. Each of the image density after irradiation, D, and that before irradiation, D0, was measured with a Macbeth reflective densitometer. The residual ratio of image after irradiation, i.e., (D/Do) x 100%, was shown as a measure of light fastness. The higher the residual ratio, the better the light fastness.

The oxidation potential of each of the triarylamine derivatives used in the examples were measured as follows.

(Measurement of Oxidation Potential)

Each compound was dissolved in a solution of tetraethylammonium perchlorate ($Et_4N^+ClO_4^-$) in acetonitrile at a concentration of 0.1 mol/l. This solution was analyzed by a polarographic analyzer (P-1100, manufactured by Yanaco) employing a rotating platinum electrode and a saturated calomel electrode as a reference electrode to obtain the primary oxidation potential. Triphenylamine was used as the standard substance for the samples to ascertain its primary oxidation potential to be 0.92 V.

The results obtained are summarized in Tables 1 to 4. Table 1 shows the effect of the addition of triarylamine derivatives for use in the present invention to a black color former in pressure-sensitive recording paper; Table 2 shows the effect of the addition of 1,2-bis[p-bis(p-methoxyphenylamino)phenoxy] ethane for use in the invention to general-purpose color formers in pressure-sensitive recording paper; Table 3 shows the effect of the addition of triarylamine derivatives for use in the present invention to a black color former in heat-sensitive recording paper; and Table 4 shows the effect of the addition of 1,2-bis[p-bis(p-methoxyphenylamino)phenoxy] ethane for use in the invention to a general-purpose color former and general-purpose color developers in heat-sensitive recording paper.

TABLE 1

Effect of the addition of triarylamine derivatives for use in the invention to a black color former in pressure-sensitive recording paper

| | Residual Ratio of Image (%) | Oxidation Potential (V) |
|---|---|---|
| Ex. 1 | 88 | 0.57 |
| Ex. 2 | 80 | 0.71 |
| Ex. 3 | 75 | 0.84 |
| Ex. 4 | 82 | 0.65 |
| Ex. 5 | 86 | 0.58 |
| Ex. 6 | 83 | 0.67 |
| Ex. 7 | 88 | 0.57 |
| Ex. 8 | 91 | 0.57 |
| Ex. 9 | 87 | 0.57 |
| Ex. 10 | 85 | 0.60 |
| Ex. 11 | 86 | 0.57 |
| Ex. 12 | 82 | 0.67 |
| Ex. 22 | 88 | — |
| Ex. 23 | 85 | — |
| Comp. Ex. 1 | 66 | — |
| Comp. Ex. 2 | 69 | — |

TABLE 2

Effect of the addition od 1,2-bis[p-bis(p-methoxyphenylamino)phenoxy]ethane for use in the invention to general-purpose color formers in pressure-sensitive recording paper

| | Residual Ratio of Image (%) |
|---|---|
| Ex. 13 | 82 |
| Ex. 14 | 70 |
| Ex. 15 | 74 |
| Ex. 16 | 72 |
| Ex. 17 | 63 |
| Ex. 18 | 69 |
| Ex. 19 | 73 |
| Ex. 20 | 79 |

TABLE 2-continued

Effect of the addition od 1,2-bis[p-bis(p-methoxyphenylamino)phenoxy]ethane for use in the invention to general-purpose color formers in pressure-sensitive recording paper

| | Residual Ratio of Image (%) |
|---|---|
| Ex. 21 | 80 |
| Ex. 1 | 88 |
| Comp. Ex. 3 | 60 |
| Comp. Ex. 4 | 42 |
| Comp. Ex. 5 | 48 |
| Comp. Ex. 6 | 45 |
| Comp. Ex. 7 | 28 |
| Comp. Ex. 8 | 40 |
| Comp. Ex. 9 | 47 |
| Comp. Ex. 10 | 55 |
| Comp. Ex. 11 | 58 |
| Comp. Ex. 1 | 66 |

*The Example and Comparative Example on each line in the table serve a comparison between the addition and nonaddition of 1,2-bis[p-bis(p-methoxyphenylamino)phenoxy]ethane to the same color former.

TABLE 3

Effect of the addition of triarylamine derivatives for use in the invention to a black color former in heat-sensitive recording paper

| | Residual Ratio of Image (%) | Oxidation Potential (V) |
|---|---|---|
| Ex. 24 | 92 | 0.57 |
| Ex. 25 | 95 | 0.54 |
| Ex. 26 | 90 | 0.58 |
| Ex. 27 | 85 | 0.82 |
| Comp. Ex. 12 | 73 | — |
| Comp. Ex. 13 | 74 | — |

TABLE 4

Effect of the addition of 1,2-bis[p-bis(p-methoxyphenylamino)phenoxy]ethane for use in the invention to a general-purpose color former and general-purpose color developers in heat-sensitive recording paper

| | Residual Ratio of Image (%) |
|---|---|
| Ex. 28 | 90 |
| Ex. 29 | 97 |
| Ex. 30 | 98 |
| Ex. 31 | 96 |
| Ex. 32 | 93 |
| Ex. 24 | 92 |
| Comp. Ex. 14 | 70 |
| Comp. Ex. 15 | 74 |
| Comp. Ex. 16 | 82 |
| Comp. Ex. 17 | 80 |
| Comp. Ex. 18 | 75 |
| Comp. Ex. 12 | 73 |

*The Example and Comparative Example on each line in the table serve a comparison between the addition and nonaddition of 1,2-bis[p-bis(p-methoxyphenylamino)phenyoxy]ethane to the same color former or color developer.

EXAMPLE 33

1) Production of Sheet Coated with Capsules Containing Electron-donating Achromatic Dye In 95 parts of water was dissolved 5 parts of a partial sodium salt of poly(vinylbenzenesulfonic acid) (VERSA, TL500; manufactured by National Starch Co.). Aqueous sodium hydroxide solution was added thereto to adjust the pH to 4.0. 100 Parts of diisopropylnaphthalene containing dissolved therein 6.8% 2-anilino-3-methyl-6-di-n-butylaminofluoran as an electron-donating achromatic dye and 15% 4,4',4"-trimethoxytriphenylamine as the compound characteristic of the present invention was emulsified into 100 parts of the 5% aqueous solution of the partial sodium salt of poly(vinylbenzenesulfonic acid) to obtain an emulsion having a particle diameter of 4.0 μm. On the other hand, a mixture of 6 parts of melamine, 11 parts of 37% aqueous formaldehyde solution, and 30 parts of water was stirred with heating at 60° C. to obtain a clear aqueous solution of a melamine-formaldehyde prepolymer. This aqueous solution was mixed with the emulsion obtained above. The pH of the mixture was adjusted to 6.0 with aqueous phosphoric acid solution with stirring, and the resulting liquid was heated to 65° C. and kept being stirred for 6 hours. The capsule dispersion thus obtained was cooled to room temperature and its pH was adjusted to 9.0 with aqueous sodium hydroxide solution. To this dispersion were added 200 parts of 10 wt% aqueous poly(vinyl alcohol) solution and 50 parts of starch particles. Water was added thereto to prepare a microcapsule dispersion having a solid content of 20%.

This coating fluid was applied on a 50 g/m$^2$ base paper with an air-knife coater in a solid amount of 5 g/m$^2$, and dried to thereby obtain a sheet coated with capsules containing an electron-donating achromatic dye.

2) Production of Sheet Coated with Electron-accepting Compound

A dispersion consisting of 14 parts of zinc 3,5-bis(α-methylbenzyl)salicylate, 80 parts of calcium carbonate, 20 parts of zinc oxide, 1 part of sodium hexametaphosphate, and 200 parts of water was treated with a sand grinder to disperse the solid ingredients to an average particle diameter of 3 μm. To this dispersion were added 100 parts of 10% aqueous PVA solution and 10 parts (as a solid amount) of a carboxylated SBR latex. Water was added thereto in such an amount as to result in a solid content of 20% to obtain a coating fluid. This coating fluid was applied on a 50 g/m$^2$ base paper with an air-knife coater in a solid amount of 5.0 g/m$^2$, and dried to thereby obtain a sheet coated with an electron-accepting compound.

The sheet coated with electron-donating achromatic dye microcapsules was superposed on the sheet coated with an electron-accepting compound in such a manner that the microcapsule-coated side of the former met the latter. Color was developed by applying a load of 300 kg/cm$^2$ to obtain a black image.

EXAMPLE 34

A microcapsule-coated sheet was obtained in the same manner as in Example 33 except that the 4,4',4"-trimethoxytriphenylamine in Example 33 was replaced by 4,4'-dimethoxy 4"-n-octyloxytriphenylamine. Color was developed in the same manner as in Example 33 to obtain a black image.

EXAMPLE 35

A microcapsule-coated sheet was obtained in the same manner as in Example 33 except that the 4,4',4"-trimethoxytriphenylamine in Example 33 was replaced by 4,4'-dimethoxy- 4"-methylphenylamine. Color was developed in the same manner as in Example 33 to obtain a black image.

EXAMPLE 36

A microcapsule-coated sheet was obtained in the same manner as in Example 33 except that the 4,4',4"-trimethoxytriphenylamine in Example 33 was replaced by 4,4'-dimethoxy- 2"-methoxytriphenylamine. Color was developed in the same manner as in Example 33 to obtain a black image.

EXAMPLE 37

A microcapsule-coated sheet was obtained in the same manner as in Example 33 except that the 4,4',4"-trimethoxytriphenylamine in Example 33 was replaced by 3,4,4',4"-tetramethoxytriphenylamine. Color was developed in the same manner as in Example 33 to obtain a black image.

EXAMPLE 38

A microcapsule-coated sheet was obtained in the same manner as in Example 33 except that the 4,4',4"-trimethoxytriphenylamine in Example 33 was replaced by 4,4'-dimethoxytriphenylamine. Color was developed in the same manner as in Example 33 to obtain a black image.

EXAMPLE 39

A microcapsule-coated sheet was obtained in the same manner as in Example 33 except that the 4,4',4"-trimethoxytriphenylamine in Example 33 was replaced by 4-methoxytriphenylamine. Color was developed in the same manner as in Example 33 to obtain a black image.

EXAMPLE 40

A microcapsule-coated sheet was obtained in the same manner as in Example 33 except that the 4,4',4"-trimethoxytriphenylamine in Example 33 was replaced by 4,4'-dimethoxy- 4"-methylthiotriphenylamine. Color was developed in the same manner as in Example 33 to obtain a black image.

EXAMPLE 41

A microcapsule-coated sheet was obtained in the same manner as in Example 33 except that the 4,4',4"-trimethoxytriphenylamine in Example 33 was replaced by 4,4'-dimethoxy- 4"-phenoxytriphenylamine. Color was developed in the same manner as in Example 33 to obtain a black image.

EXAMPLE 42

A microcapsule-coated sheet was obtained in the same manner as in Example 33 except that the 4,4',4"-trimethoxytriphenylamine in Example 33 was replaced by 2,4,4',4" -tetramethoxytriphenylamine. Color was developed in the same manner as in Example 33 to obtain a black image.

EXAMPLE 43

A microcapsule-coated sheet was obtained in the same manner as in Example 33 except that the 4,4',4"-trimethoxytriphenylamine in Example 33 was replaced by 10-p-methoxyphenylphenoxazine. Color was developed in the same manner as in Example 33 to obtain a black image.

EXAMPLE 44

A microcapsule-coated sheet was obtained in the same manner as in Example 33 except that the 4,4',4"-trimethoxytriphenylamine in Example 33 was replaced by 4,4'-dimethoxyphenyl- 1"-naphthylamine. Color was developed in the same manner as in Example 33 to obtain a black image.

EXAMPLE 45

A microcapsule-coated sheet was obtained in the same manner as in Example 33 except that the 4,4',4"-trimethoxytriphenylamine in Example 33 was replaced by N-methoxyphenyliminostilbene. Color was developed in the same manner as in Example 33 to obtain a black image.

EXAMPLE 46

A microcapsule-coated sheet was obtained in the same manner as in Example 33 except that the 4,4',4"-trimethoxytriphenylamine in Example 33 was replaced by N,N,N',N'-tetraphenyl-p-phenylenediamine. Color was developed in the same manner as in Example 33 to obtain a black image.

EXAMPLE 47

A microcapsule-coated sheet was obtained in the same manner as in Example 33 except that the 2-anilino-3-methyl-6-di-n-butylaminofluoran in Example 33 was replaced by 2-anilino- 6-N-ethyl-N-n-hexylaminofluoran. Color was developed in the same manner as in Example 33 to obtain a green image.

EXAMPLE 48

A microcapsule-coated sheet was obtained in the same manner as in Example 33 except that the 2-anilino-3-methyl-6 -di-n-butylaminofluoran in Example 33 was replaced by 3,3-bis( 4-dimethylaminophenyl)-6-dimethylaminophthalide (crystal violet lactone). Color was developed in the same manner as in Example 33 to obtain a blue image.

EXAMPLE 49

A microcapsule-coated sheet was obtained in the same manner as in Example 33 except that the 2-anilino-3-methyl-6 -di-n-butylaminofluoran in Example 33 was replaced by 3-(4 -diethylamino-2-ethoxyphenyl)-3-(1-n-octyl-2-methylindol-3 -yl)phthalide. Color was developed in the same manner as in Example 33 to obtain a blue image.

EXAMPLE 50

A microcapsule-coated sheet was obtained in the same manner as in Example 33 except that the 2-anilino-3-methyl-6 -di-n-butylaminofluoran in Example 33 was replaced by 3,3 -bis(1-n-octyl-2-methylindol-3-yl)phthalide. Color was developed in the same manner as in Example 33 to obtain a red image.

EXAMPLE 51

A microcapsule-coated sheet was obtained in the same manner as in Example 33 except that the 2-anilino-3-methyl-6 -di-n-butylaminofluoran in Example 33 was replaced by 3-[1 -bis(4-diethylaminophenyl)ethylene-2-yl]-6-dimethylaminophthalide. Color was developed in the same manner as in Example 33 to obtain a cyan image.

EXAMPLE 52

A microcapsule-coated sheet was obtained in the same manner as in Example 33 except that the 2-anilino-3-methyl-6 -di-n-butylaminofluoran in Example 33 was replaced by 3,6 -bis(dimethylamino)fluorene-9-spiro-3'-(6'-dimethylamino)phthalide. Color was developed in the same manner as in Example 33 to obtain a blue-green image.

EXAMPLE 53

A microcapsule-coated sheet was obtained in the same manner as in Example 33 except that the 2-anilino-3-methyl-6 -di-n-butylaminofluoran in Example 33 was replaced by 3 -diethylamino-7,8-benzofluoran. Color was developed in the same manner as in Example 33 to obtain a red image.

EXAMPLE 54

A microcapsule-coated sheet was obtained in the same manner as in Example 33 except that the 2-anilino-3-methyl-6 -di-n-butylaminofluoran in Example 33 was replaced by 3,3 -bis(4-diethylamino-2-methylphenyl)-4,7-diazaphthalide. Color was developed in the same manner as in Example 33 to obtain a green image.

EXAMPLE 55

A microcapsule-coated sheet was obtained in the same manner as in Example 33 except that the 2-anilino-3-methyl-6 -di-n-butylaminofluoran in Example 33 was replaced by 3,3 -bis(4-diethylamino-2-ethoxyphenyl)-4-azaphthalide. Color was developed in the same manner as in Example 33 to obtain a cyan image.

EXAMPLE 56

A microcapsule-coated sheet was obtained in the same manner as in Example 33 except that 100 parts of diisopropylnaphthalene containing dissolved therein 5% 4,4',4" -trimethoxytriphenylamine and 10% 4,4'-dimethoxytriphenylamine was used in place of 100 parts of the diisopropylnaphtalene containing dissolved therein 15% 4,4',4"-trimethoxytriphenylamine as used in Example 33. Color was developed in the same manner as in Example 33 to obtain a black image.

EXAMPLE 57

A microcapsule-coated sheet was obtained in the same manner as in Example 33 except that 100 parts of diisopropylnaphthalene containing dissolved therein 5% 4,4',4"-trimethoxytriphenylamine and 10% o-benzotriazolyl-p-methylphenol was used in place of 100 parts of the diisopropylnaphtalene containing dissolved therein 15% 4,4',4"-trimethoxytriphenylamine as used in Example 33. Color was developed in the same manner as in Example 33 to obtain a black image.

EXAMPLE 58

Each of 2-anilino-3-methyl-6-di-n-butylaminofluoran as an electron-donating achromatic dye, bisphenol A as an electron-accepting compound, and 4,4',4"-trimethoxytriphenylamine as the compound of the present invention was dispersed in an amount of 20 g into 100 g of a 5% aqueous solution of poly(vinyl alcohol) (Kuraray PVA 105) with a ball mill for a whole day and night to reduce the particles to a volume-average particle diameter of 3 μm. On the other hand, 80 g of calcined kaolin (Anisilex-93) was dispersed into 160 g of a 0.5% solution of sodium hexametaphosphate with a homogenizer.

The dispersions thus prepared were mixed together in such a proportion that the amount of the dispersion of the electron-donating achromatic dye was 5 g, that of the dispersion of the electron-accepting compound 10 g, that of the dispersion of the compound of the present invention 10 g, and that of the calcined-kaolin dispersion 22 g. Further, 4 g of an emulsion of zinc stearate and 5 g of a 2% aqueous solution of sodium di(2-ethylhexyl)sulfosuccinate were added to the mixture to obtain a coating fluid. This coating fluid was applied on a fine quality paper having a basis weight of 50 g/m$^2$ with a wire-wound bar in a solid amount of 6 g/m$^2$, and the coating was calendered to thereby obtain a coated paper.

The coated paper thus obtained was subjected to printing with a thermal head (KLT-216-8MPD1) manufactured by Kyocera Corp. to obtain a black image.

EXAMPLE 59

A coated paper was obtained in the same manner as in Example 58 except that the 4,4',4"-trimethoxytriphenylamine in Example 58 was replaced by 4,4'-dimethoxy-4"-phenoxyphenylamine. Color was developed in the same manner as in Example 58 to obtain a black image.

EXAMPLE 60

A coated paper was obtained in the same manner as in Example 58 except that the 4,4',4"-trimethoxytriphenylamine in Example 58 was replaced by N,N,N',N'-tetraphenyl-p-phenylenediamine. Color was developed in the same manner as in Example 58 to obtain a black image.

EXAMPLE 61

A coated paper was obtained in the same manner as in Example 58 except that the 2-anilino-3-methyl-6-di-n-butylaminofluoran in Example 58 was replaced by 2-(m-trifluoromethylanilino)- 6-diethylaminofluoran. Color was developed in the same manner as in Example 58 to obtain a black image.

EXAMPLE 62

A coated paper was obtained in the same manner as in Example 58 except that the bisphenol A in Example 58 was replaced by 4-isopropyloxyphenyl-4'-hydroxyphenyl sulfone. Color was developed in the same manner as in Example 58 to obtain a black image.

EXAMPLE 63

A coated paper was obtained in the same manner as in Example 58 except that the bisphenol A in Example 58 was replaced by zinc 5-[2-(4-methoxyphenoxy)ethoxy]salicylate. Color was developed in the same manner as in Example 58 to obtain a black image.

EXAMPLE 64

A coated paper was obtained in the same manner as in Example 58 except that the bisphenol A in Example 58 was replaced by zinc 2-phenoxyacetamidobenzoate. Color was developed in the same manner as in Example 58 to obtain a black image.

EXAMPLE 65

A coated paper was obtained in the same manner as in Example 58 except that the bisphenol A in Example 58 was replaced by 4-n-octyloxycarbonylphenol. Color was developed in the same manner as in Example 58 to obtain a black image.

COMPARATIVE EXAMPLE 19

A microcapsule-coated sheet was obtained in the same manner as in Example 33 except-that the 4,4',4"-trimethoxytriphenylamine used in Example 33 was omitted. Color was developed in the same manner as in Example 33 to obtain a black image.

COMPARATIVE EXAMPLE 20

A microcapsule-coated sheet was obtained in the same manner as in Example 33 except that triphenylamine was used in place of the 4,4',4"-trimethoxytriphenylamine in Example 33. Color was developed in the same manner as in Example 33 to obtain a black image.

COMPARATIVE EXAMPLE 21

A microcapsule-coated sheet was obtained in the same manner as in Example 33 except that N,N-diphenyl-p-phenylenediamine was used in place of the 4,4',4"-trimethoxytriphenylamine in Example 33. Color was developed in the same manner as in Example 33 to obtain a black image.

COMPARATIVE EXAMPLE 22

A microcapsule-coated sheet was obtained in the same manner as in Example 33 except that o-benzotriazolyl-p-methylphenol was used in place of the 4,4',4"-trimethoxytriphenylamine in Example 33. Color was developed in the same manner as in Example 33 to obtain a black image.

COMPARATIVE EXAMPLE 23

A microcapsule-coated sheet was obtained in the same manner as in Example 47 except that the 4,4',4"-trimethoxytriphenylamine used in Example 47 was omitted. Color was developed in the same manner as in Example 47 to obtain a green image.

COMPARATIVE EXAMPLE 24

A microcapsule-coated sheet was obtained in the same manner as in Example 48 except that the 4,4',4"-trimethoxytriphenylamine used in Example 48 was omitted. Color was developed in the same manner as in Example 48 to obtain a blue image.

COMPARATIVE EXAMPLE 25

A microcapsule-coated sheet was obtained in the same manner as in Example 49 except that the 4,4',4"-trimethoxytriphenylamine used in Example 49 was omitted. Color was developed in the same manner as in Example 49 to obtain a blue image.

COMPARATIVE EXAMPLE 26

A microcapsule-coated sheet was obtained in the same manner as in Example 50 except that the 4,4',4"-trimethoxytriphenylamine used in Example 50 was omitted. Color was developed in the same manner as in Example 50 to obtain a red image.

COMPARATIVE EXAMPLE 27

A microcapsule-coated sheet was obtained in the same manner as in Example 51 except that the 4,4',4"-trimethoxytriphenylamine used in Example 51 was omitted. Color was developed in the same manner as in Example 51 to obtain a cyan image.

COMPARATIVE EXAMPLE 28

A microcapsule-coated sheet was obtained in the same manner as in Example 52 except that the 4,4',4"-trimethoxytriphenylamine used in Example 52 was omitted. Color was developed in the same manner as in Example 52 to obtain a blue-green image.

COMPARATIVE EXAMPLE 29

A microcapsule-coated sheet was obtained in the same manner as in Example 53 except that the 4,4',4"-trimethoxytriphenylamine used in Example 53 was omitted. Color was developed in the same manner as in Example 53 to obtain a red image.

COMPARATIVE EXAMPLE 30

A microcapsule-coated sheet was obtained in the same manner as in Example 54 except that the 4,4',4"-trimethoxytriphenylamine used in Example 54 was omitted. Color was developed in the same manner as in Example 54 to obtain a green image.

COMPARATIVE EXAMPLE 31

A microcapsule-coated sheet was obtained in the same manner as in Example 55 except that the 4,4',4"-trimethoxytriphenylamine used in Example 55 was omitted. Color was developed in the same manner as in Example 55 to obtain a cyan image.

COMPARATIVE EXAMPLE 32

A coated paper was obtained in the same manner as in Example 58 except that the 4,4',4"-trimethoxytriphenylamine used in Example 58 was omitted. Color was developed in the same manner as in Example 58 to obtain a black image.

COMPARATIVE EXAMPLE 33

A coated paper was obtained in the same manner as in Example 58 except that o-benzotriazolyl-p-methylphenol was used in place of the 4,4',4"-trimethoxytriphenylamine in Example 58. Color was developed in the same manner as in Example 58 to obtain a black image.

COMPARATIVE EXAMPLE 34

A coated paper was obtained in the same manner as in Example 61 except that the 4,4',4"-trimethoxytriphenylamine used in Example 61 was omitted. Color was developed in the same manner as in Example 61 to obtain a black image.

COMPARATIVE EXAMPLE 35

A coated paper was obtained in the same manner as in Example 62 except that the 4,4',4"-trimethoxytriphenylamine used in Example 62 was omitted. Color was developed in the same manner as in Example 62 to obtain a black image.

COMPARATIVE EXAMPLE 36

A coated paper was obtained in the same manner as in Example 63 except that the 4,4',4"-trimethoxytriphenylamine used in Example 63 was omitted. Color was developed in the same manner as in Example 63 to obtain a black image.

COMPARATIVE EXAMPLE 37

A coated paper was obtained in the same manner as in Example 64 except that the 4,4',4"-trimethoxytriphenylamine used in Example 64 was omitted. Color was developed in the same manner as in Example 64 to obtain a black image.

COMPARATIVE EXAMPLE 38

A coated paper was obtained in the same manner as in Example 65 except that the 4,4',4"-trimethoxytriphenylamine used in Example 65 was omitted. Color was developed in the same manner as in Example 65 to obtain a black image.

The recording materials obtained in Examples 33 to 65 and Comparative Examples 19 to 38 were evaluated for lightfastness by the same image lightfastness test as stated above.

In the test, the irradiation time for Examples 33 to 57 and Comparative Examples 19 to 31 was 4 hours and that for Examples 58 to 65 and Comparative Examples 32 to 38 was 24 hours. Each of the image density after irradiation, D, and that before irradiation, $D_0$, was measured with a Macbeth reflective densitometer. The residual ratio of image after irradiation, i.e., $(D/D_0)\times100\%$, was shown as a measure of lightfastness. The higher the residual ratio, the better the lightfastness.

The oxidation potential of each of the triarylamine derivatives used in the examples were measured by the same measurement method as stated above.

The results obtained are summarized in Tables 5 to 8. Table 5 shows the effect of the addition of triarylamine derivatives for use in the invention to a black color former in pressure-sensitive recording paper; Table 6 shows the effect of the addition of 4,4',4"-trimethoxytriphenylamine for use in the invention to general-purpose color formers in pressure-sensitive recording paper; Table 7 shows the effect of the addition of triarylamine derivatives for use in the invention to a black color former in heat-sensitive recording paper; and Table 8 shows the effect of the addition of 4,4',4"-trimethoxytriphenylamine for use in the invention to a general-purpose color former and general-purpose color developers in heat-sensitive recording paper.

TABLE 5

Effect of the addition of triarylamine derivatives for use in the invention to a black color former in pressure-sensitive recording paper

| | Residual Ratio of Image (%) | Oxidation Potential (V) |
|---|---|---|
| Ex. 33 | 89 | 0.52 |
| Ex. 34 | 87 | 0.54 |
| Ex. 35 | 86 | 0.64 |
| Ex. 36 | 87 | 0.61 |
| Ex. 37 | 86 | 0.52 |
| Ex. 38 | 83 | 0.63 |

TABLE 5-continued

Effect of the addition of triarylamine derivatives for use in the invention to a black color former in pressure-sensitive recording paper

| | Residual Ratio of Image (%) | Oxidation Potential (V) |
|---|---|---|
| Ex. 39 | 82 | 0.76 |
| Ex. 40 | 83 | 0.56 |
| Ex. 41 | 82 | 0.57 |
| Ex. 42 | 84 | 0.52 |
| Ex. 43 | 84 | 0.64 |
| Ex. 44 | 82 | 0.66 |
| Ex. 45 | 81 | 0.72 |
| Ex. 46 | 86 | 0.47 |
| Ex. 56 | 88 | — |
| Ex. 57 | 87 | — |
| Comp. Ex. 19 | 66 | — |
| Comp. Ex. 20 | 67 | 0.92 |
| Comp. Ex. 21 | 66 | 1.06 |
| Comp. Ex. 22 | 69 | — |

TABLE 6

Effect of the addition of 4,4',4"-trimethoxytriphenylamine for use in the invention to general-purpose color formers in pressure-sensitive recording paper

| | Residual Ratio of Image (%) |
|---|---|
| Ex. 47 | 89 |
| Ex. 48 | 72 |
| Ex. 49 | 75 |
| Ex. 50 | 74 |
| Ex. 51 | 65 |
| Ex. 52 | 70 |
| Ex. 53 | 73 |
| Ex. 54 | 85 |
| Ex. 55 | 88 |
| Comp. Ex. 23 | 60 |
| Comp. Ex. 24 | 42 |
| Comp. Ex. 25 | 48 |
| Comp. Ex. 26 | 45 |
| Comp. Ex. 27 | 28 |
| Comp. Ex. 28 | 40 |
| Comp. Ex. 29 | 47 |
| Comp. Ex. 30 | 55 |
| Comp. Ex. 31 | 58 |

*The Example and Comparative Example on each line in the table serve a comparison between the addition and nonaddition of 4,4',4"-trimethoxytriphenylamine to the same color former.

TABLE 7

Effect of the addition of triarylamine derivatives for use in the invention to a black color former in heat-sensitive recording paper

| | Residual Ratio of Image (%) | Oxidation Potential (V) |
|---|---|---|
| Ex. 58 | 94 | 0.52 |
| Ex. 59 | 93 | 0.57 |
| Ex. 60 | 96 | 0.47 |
| Comp. Ex. 32 | 73 | — |
| Comp. Ex. 33 | 74 | — |

TABLE 8

Effect of the addition of 4,4',4"-trimethoxytriphenylamine for use in the invention to a general-purpose color former and general-purpose color developers in heat-sensitive recording paper

| | Residual Ratio of Image (%) |
|---|---|
| Ex. 61 | 92 |
| Ex. 62 | 98 |
| Ex. 63 | 99 |
| Ex. 64 | 98 |
| Ex. 65 | 88 |
| Comp. Ex. 34 | 70 |
| Comp. Ex. 35 | 74 |
| Comp. Ex. 36 | 82 |
| Comp. Ex. 37 | 80 |
| Comp. Ex. 38 | 62 |

*The Example and Comparative Example on each line in the table serve a comparison between the addition and nonaddition of 4,4',4"-trimethoxytriphenylamine to the same color former or color developer.

EXAMPLE 66

1) Preparation of electron-donating achromatic dye-containing capsule sheet:

In 95 parts of water was dissolved 5 parts of a partial sodium salt of polyvinylbenzenesulfonic acid ("VERSA, TL500" produced by National Starch Co., Ltd.), and the solution was adjusted to pH 4.0 with a sodium hydroxide aqueous solution. A hundred parts of diisopropylnaphthalene having dissolved therein 6.8% of 2-anilino-3-methyl-6-di-n-butylaminofluoran and 15% of bis[p-bis(p-methoxyphenyl)aminophenyl]ether (the compound of general formula (4) of the present invention) were emulsified in 100 parts of the above-prepared 5% aqueous solution of a partial sodium salt of polyvinylbenzenesulfonic acid to prepare an emulsion having a particle diameter of 4.0 μm.

Separately, a mixture of 6 parts of melamine, 11 parts of a 37% aqueous solution of formaldehyde, and 30 parts of water was heated to 60° C. with stirring to prepare a clear aqueous solution of an initial melamine-formaldehyde polymerization product. The solution was mixed with the above-prepared emulsion. The mixture was adjusted to pH 6.0 with a phosphoric acid aqueous solution while stirring, and the liquid temperature was raised to 65° C., at which the stirring was continued for a period of 6 hours. The resulting capsule dispersion was cooled to room temperature and adjusted to pH 9.0 with a sodium hydroxide aqueous solution.

To the resulting dispersion were added 200 parts of a 10% polyvinyl alcohol aqueous solution and 50 parts of starch particles, and water was added thereto to adjust to a solids content of 20%.

The thus prepared coating composition was applied on paper having a basis weight of 50 g/m$^2$ to a solid coating weight of 5 g/m$^2$ with an air knife coater and dried to obtain an electron-donating achromatic dye-containing capsule sheet.

2) Preparation of electron-accepting compound sheet:

A mixture consisting of 14 parts of zinc 3,5-bis(α-methylbenzyl)salicylate, 80 parts of calcium carbonate, 20 parts of zinc oxide, 1 part of sodium hexametaphosphate, and 200 parts of water was dispersed in a sand grinder to an average particle size of 3 μm. To the dispersion were added 100 parts of a 10% polyvinyl alcohol aqueous solution and 10 parts (on a solid basis) of a carboxyl-modified SBR latex, and water was added to adjust to a solids content of 20%. The resulting coating composition was coated on paper having a basis weight of 50 g/m$^2$ to a solid coating weight of 5.0 g/m$^2$ with an air knife coater and dried to obtain an electron-accepting compound sheet.

The electron-donating achromatic dye-containing microcapsule sheet was superposed on the electron-accepting compound sheet with both the coated surfaces contacting each other, and a load of 300 kg/cm$^2$ was applied thereto to cause color formation to provide a black color image.

EXAMPLE 67

A microcapsule sheet was prepared in the same manner as in Example 66, except for replacing bis[p-bis(p-methoxyphenyl)aminophenyl] ether with bis(p-diphenylaminophenyl) ether. Color formation was conducted in the same manner as in Example 66 to obtain a black image.

EXAMPLE 68

A microcapsule sheet was prepared in the same manner as in Example 66, except for replacing bis[p-bis(p-methoxyphenyl)aminophenyl] ether with bis[p-di(p-tolyl)aminophenyl] ether. Color formation was conducted in the same manner as in Example 66 to obtain a black image.

EXAMPLE 69

A microcapsule sheet was prepared in the same manner as in Example 66, except for replacing bis[p-bis(p-methoxyphenyl)aminophenyl] ether with bis[p-[N-(p-methoxyphenyl)-N-(p-tolyl)amino] phenyl]ether. Color formation was conducted in the same manner as in Example 66 to obtain a black image.

EXAMPLE 70

A microcapsule sheet was prepared in the same manner as in Example 66, except for replacing bis[p-bis(p-methoxyphenyl)aminophenyl] ether with bis[p-bis(p-methoxyphenyl)aminophenyl] sulfide. Color formation was conducted in the same manner as in Example 66 to obtain a black image.

EXAMPLE 71

A microcapsule sheet was prepared in the same manner as in Example 66, except for replacing bis[p-bis(p-methoxyphenyl)aminophenyl] ether with 1,2-bis[p-[N-(p-methoxyphenyl)-N-(p-tolyl)amino] phenyl]ethylene. Color formation was conducted in the same manner as in Example 66 to obtain a black image.

EXAMPLE 72

A microcapsule sheet was prepared in the same manner as in Example 66, except for replacing bis[p-bis(p-methoxyphenyl)aminophenyl] ether with 1,2-bis[p-bis(p-methoxyphenyl)aminophenyl] acetylene. Color formation was conducted in the same manner as in Example 66 to obtain a black image.

EXAMPLE 73

A microcapsule sheet was prepared in the same manner as in Example 66, except for replacing bis[p-bis(p-methoxyphenyl)aminophenyl] ether with m-bis(p-methoxyphenyl)aminophenyl-p-bis(p-methoxyphenyl)aminophenyl ether. Color formation was conducted in the same manner as in Example 66 to obtain a black image.

EXAMPLE 74

A microcapsule sheet was prepared in the same manner as in Example 66, except for replacing bis[p-bis(p-methoxyphenyl)aminophenyl] ether with bis[m-bis(p-methoxyphenyl)aminophenyl] ether. Color formation was conducted in the same manner as in Example 66 to obtain a black image.

EXAMPLE 75

A microcapsule sheet was prepared in the same manner as in Example 66, except for replacing bis[p-bis(p-methoxyphenyl)aminophenyl] ether with m-bis(p-methoxyphenyl)aminophenyl-p-bis(p-methoxyphenyl)aminophenyl sulfide. Color formation was conducted in the same manner as in Example 66 to obtain a black image.

EXAMPLE 76

A microcapsule sheet was prepared in the same manner as in Example 66, except for replacing 2-anilino-3-methyl-6 -di-n-butylaminofluoran with 2-anilino-6-N-ethyl-N-n-hexylaminofluoran. Color formation was conducted in the same manner as in Example 66 to obtain a green image.

EXAMPLE 77

A microcapsule sheet was prepared in the same manner as in Example 66, except for replacing 2-anilino-3-methyl-6 -di-n-butylaminofluoran with 3,3-bis(4-dimethylaminophenyl)-6 -dimethylaminophthalide (Crystal Violet Lactone). Color formation was conducted in the same manner as in Example 66 to obtain a blue image.

EXAMPLE 78

A microcapsule sheet was prepared in the same manner as in Example 66, except for replacing 2-anilino-3-methyl-6 -di-n-butylaminofluoran with 3-(4-diethylamino-2-ethoxyphenyl)-3 -(1-n-octyl-2-methylindol-3-yl)phthalide. Color formation was conducted in the same manner as in Example 66 to obtain a blue image.

EXAMPLE 79

A microcapsule sheet was prepared in the same manner as in Example 66, except for replacing 2-anilino-3-methyl-6 -di-n-butylaminofluoran with 3,3-bis(1-n-octyl-2-methylindol-3 -yl)phthalide. Color formation was conducted in the same manner as in Example 66 to obtain a red image.

EXAMPLE 80

A microcapsule sheet was prepared in the same manner as in Example 66, except for replacing 2-anilino-3-methyl-6 -di-n-butylaminofluoran with 3-[1-bis(4 -diethylaminophenyl)ethylen-2-yl]-6-dimethylaminophthalide. Color formation was conducted in the same manner as in Example 66 to obtain a cyan image.

EXAMPLE 81

A microcapsule sheet was prepared in the same manner as in Example 66, except for replacing 2-anilino-3-methyl-6 -di-n-butylaminofluoran with 3,6-bis(dimethylamino)fluoren-9 -spiro-3'-(6'-dimethylamino)phthalide. Color formation was conducted in the same manner as in Example 66 to obtain a bluish green image.

EXAMPLE 82

A microcapsule sheet was prepared in the same manner as in Example 66, except for replacing 2-anilino-3-methyl-6 -di-n-butylaminofluoran with 3-diethylamino-7,8-benzofluoran. Color formation was conducted in the same manner as in Example 66 to obtain a red image.

EXAMPLE 83

A microcapsule sheet was prepared in the same manner as in Example 66, except for replacing 2-anilino-3-methyl-6 -di-n-butylaminofluoran with 3,3-bis(4-diethylamino-2 -methylphenyl)-4,7-diazaphthalide. Color formation was conducted in the same manner as in Example 66 to obtain a green image.

EXAMPLE 84

A microcapsule sheet was prepared in the same manner as in Example 66, except for replacing 2-anilino-3-methyl-6 -di-n-butylaminofluoran with 3,3-bis(4-diethylamino-2 -ethoxyphenyl)-4-azaphthalide. Color formation was conducted in the same manner as in Example 66 to obtain a cyan image.

EXAMPLE 85

A microcapsule sheet was prepared in the same manner as in Example 66, except for replacing 100 parts of diisopropylnaphthalene having dissolved therein 15% bis[ p-bis(p-methoxyphenyl)aminophenyl]ether with 100 parts of diisopropylnaphthalene having dissolved therein 5% bis[ p-bis(p-methoxyphenyl)aminophenyl]ether and 10% bis(p-diphenylaminophenyl) ether. Color formation was conducted in the same manner as in Example 66 to obtain a black image.

EXAMPLE 86

A microcapsule sheet was prepared in the same manner as in Example 66, except for replacing 100 parts of diisopropylnaphthalene having dissolved therein 15% bis[ p-bis(p-methoxyphenyl)aminophenyl]ether with 100 parts of diisopropylnaphthalene having dissolved therein 5% bis[ p-bis(p-methoxyphenyl)aminophenyl]ether and 10% o-benzotriazolyl-p-methylphenol. Color formation was conducted in the same manner as in Example 66 to obtain a black image.

EXAMPLE 87

Each of 2-anilino-3-methyl-6-di-n-butylaminofluoran as an electron-donating achromatic dye, bisphenol A as an electron-accepting compound, and bis[p-bis(p-methoxyphenyl)aminophenyl] ether (the compound of the present invention), each weighing 20 g, was dispersed in 100 g of a 5% aqueous solution of polyvinyl alcohol "Kuraray PVA 105" by means of a ball mill for one day to a volume average particle size of 3 μm to prepare an electron-donating achromatic dye dispersion, an electron-accepting compound dispersion, and a dispersion of the compound of the present invention. Separately, 80 g of calcined kaolin "Anisilex-93" and 160 g of a 0.5% solution of sodium hexametaphosphate were dispersed in a homogenizer.

Five grams of the electron-donating achromatic dye dispersion, 10 g of the electron-accepting compound dispersion, 10 g of the dispersion of the compound of the present invention, and 22 g of the calcined kaolin dispersion were mixed, and 4 g of a zinc stearate emulsion and 5 g of a 2% aqueous solution of sodium di(2-ethylhexyl)sulfosuccinate were added to the mixture to prepare a coating composition. The coating composition was applied to fine quality paper having a basis weight of 50 g/m$^2$ to a solid coating weight of 6 g/m$^2$ with a wire bar, dried, and calendered to obtain coated paper.

The resulting coated paper was printed with a thermal head "KLT-216-8MPD1" manufactured by Kyocera Corporation to form a black image.

EXAMPLE 88

Coated paper was prepared in the same manner as in Example 87, except for replacing bis[p-bis(p-methoxyphenyl)aminophenyl] ether with bis[p-di(p-tolyl)aminophenyl] ether. Color formation was conducted in the same manner as in Example 87 to obtain a black image.

EXAMPLE 89

Coated paper was prepared in the same manner as in Example 87, except for replacing bis[p-bis(p-methoxyphenyl)aminophenyl] ether with m-bis(p-methoxyphenyl)aminophenyl-p-bis(p-methoxyphenyl)aminophenyl ether. Color formation was conducted in the same manner as in Example 87 to obtain a black image.

EXAMPLE 90

Coated paper was prepared in the same manner as in Example 87, except for replacing bis[p-bis(p-methoxyphenyl)aminophenyl] ether with bis[p-bis(p-methoxyphenyl)aminophenyl] sulfide. Color formation was conducted in the same manner as in Example 87 to obtain a black image.

EXAMPLE 91

Coated paper was prepared in the same manner as in Example 87, except for replacing 2-anilino-3-methyl-6 -di-n-butylaminofluoran with 2-(m-trifluoromethylanilino)-6-diethylaminofluoran. Color formation was conducted in the same manner as in Example 87 to obtain a black image.

EXAMPLE 92

Coated paper was prepared in the same manner as in Example 87, except for replacing bisphenol A with 4-isopropyloxyphenyl- 4'-hydroxyphenylsulfone. Color formation was conducted in the same manner as in Example 87 to obtain a black image.

EXAMPLE 93

Coated paper was prepared in the same manner as in Example 87, except for replacing bisphenol A with zinc 5-[2 -(4-methoxyphenoxy)ethoxy] salicylate. Color formation was conducted in the same manner as in Example 87 to obtain a black image.

EXAMPLE 94

Coated paper was prepared in the same manner as in Example 87, except for replacing bisphenol A with zinc 2 -phenoxyacetamidobenzoate. Color formation was conducted in the same manner as in Example 87 to obtain a black image.

EXAMPLE 95

Coated paper was prepared in the same manner as in Example 87, except for replacing bisphenol A with 1,5 -bis(3,5-dihydroxyphenylcarbonyloxy)pentane. Color formation was conducted in the same manner as in Example 87 to obtain a black image.

COMPARATIVE EXAMPLE 39

A microcapsule sheet was prepared in the same manner as in Example 66, except that the bis[p-bis(p-methoxyphenyl)aminophenyl] ether was not used. Color formation was conducted in the same manner as in Example 66 to obtain a black image.

COMPARATIVE EXAMPLE 40

A microcapsule sheet was prepared in the same manner as in Example 66, except for replacing bis[p-bis(p-methoxyphenyl)aminophenyl] ether with o-benzotriazolyl-p-methylphenol. Color formation was conducted in the same manner as in Example 66 to obtain a black image.

COMPARATIVE EXAMPLE 41

A microcapsule sheet was prepared in the same manner as in Example 66, except for replacing bis[p-bis(p-methoxyphenyl)aminophenyl] ether with triphenylamine. Color formation was conducted in the same manner as in Example 66 to obtain a black image.

COMPARATIVE EXAMPLE 42

A microcapsule sheet was prepared in the same manner as in Example 76, except that the bis[p-bis(p-methoxyphenyl)aminophenyl] ether was not used. Color formation was conducted in the same manner as in Example 76 to obtain a green image.

COMPARATIVE EXAMPLE 43

A microcapsule sheet was prepared in the same manner as in Example 77, except that the bis[p-bis(p-methoxyphenyl)aminophenyl] ether was not used. Color formation was conducted in the same manner as in Example 77 to obtain a blue image.

COMPARATIVE EXAMPLE 44

A microcapsule sheet was prepared in the same manner as in Example 78, except that the bis[p-bis(p-methoxyphenyl)aminophenyl] ether was not used. Color formation was conducted in the same manner as in Example 78 to obtain a blue image.

COMPARATIVE EXAMPLE 45

A microcapsule sheet was prepared in the same manner as in Example 79, except that the bis[p-bis(p-methoxyphenyl)aminophenyl] ether was not used. Color formation was conducted in the same manner as in Example 79 to obtain a red image.

COMPARATIVE EXAMPLE 46

A microcapsule sheet was prepared in the same manner as in Example 80, except that the bis[p-bis(p-methoxyphenyl)aminophenyl] ether was not used. Color formation was conducted in the same manner as in Example 80 to obtain a cyan image.

COMPARATIVE EXAMPLE 47

A microcapsule sheet was prepared in the same manner as in Example 81, except that the bis[p-bis(p-methoxyphenyl)aminophenyl] ether was not used. Color formation was conducted in the same manner as in Example 81 to obtain a bluish green image.

COMPARATIVE EXAMPLE 48

A microcapsule sheet was prepared in the same manner as in Example 82, except that the bis[p-bis(p-methoxyphenyl)aminophenyl] ether was not used. Color formation was conducted in the same manner as in Example 82 to obtain a red image.

COMPARATIVE EXAMPLE 49

A microcapsule sheet was prepared in the same manner as in Example 83, except that the bis[p-bis(p-methoxyphenyl)aminophenyl] ether was not used. Color formation was conducted in the same manner as in Example 83 to obtain a green image.

COMPARATIVE EXAMPLE 50

A microcapsule sheet was prepared in the same manner as in Example 84, except that the bis[p-bis(p-methoxyphenyl)aminophenyl] ether was not used. Color formation was conducted in the same manner as in Example 84 to obtain a cyan image.

COMPARATIVE EXAMPLE 51

Coated paper was prepared in the same manner as in Example 87, except that the bis[p-bis(p-methoxyphenyl)aminophenyl] ether was not used. Color formation was conducted in the same manner as in Example 87 to obtain a black image.

COMPARATIVE EXAMPLE 52

Coated paper was prepared in the same manner as in Example 87, except for replacing bis[p-bis(p-methoxyphenyl)aminophenyl] ether with o-benzotriazolyl-p-methylphenol. Color formation was conducted in the same manner as in Example 87 to obtain a black image.

COMPARATIVE EXAMPLE 53

Coated paper was prepared in the same manner as in Example 91, except that the bis[p-bis(p-methoxyphenyl)aminophenyl] ether was not used. Color formation was conducted in the same manner as in Example 91 to obtain a black image.

COMPARATIVE EXAMPLE 54

Coated paper was prepared in the same manner as in Example 92, except that the bis[p-bis(p-methoxyphenyl)aminophenyl] ether was not used. Color formation was conducted in the same manner as in Example 92 to obtain a black image.

COMPARATIVE EXAMPLE 55

Coated paper was prepared in the same manner as in Example 93, except that the bis[p-bis(p-methoxyphenyl)aminophenyl] ether was not used. Color formation was conducted in the same manner as in Example 93 to obtain a black image.

COMPARATIVE EXAMPLE 56

Coated paper was prepared in the same manner as in Example 94, except that the bis[p-bis(p-methoxyphenyl)aminophenyl] ether was not used. Color formation was conducted in the same manner as in Example 94 to obtain a black image.

COMPARATIVE EXAMPLE 57

Coated paper was prepared in the same manner as in Example 95, except that the bis[p-bis(p-methoxyphenyl)aminophenyl] ether was not used. Color formation was conducted in the same manner as in Example 95 to obtain a black image.

Light fastness of the images obtained in Examples 66 to 95 and Comparative Examples 39 to 57 was evaluated by the same image light fastness test method as described above.

In the test, the irradiation time for the samples of Examples 66 to 86 and Comparative Examples 39 to 49 was 4 hours, and that for the samples of Examples 87 to 95 and Comparative Examples 50 to 57 was 24 hours. The image density after irradiation (D) and that before irradiation ($D_0$) were measured, and the residual ratio of images after irradiation, i.e., $[(D/D_0)\times 100\%]$ were obtained. The higher the residual ratio, the more excellent the light fastness.

The oxidation potential each of the triarylamine derivatives used in Examples was measured by the same measurement method as described above.

The measurement results obtained are shown in Tables 9 to 12 below. Table 9 shows the effect of addition of the triarylamine derivatives of the present invention on black color formers in pressure-sensitive recording papers. Table 10 indicates the effect of addition of bis[p-(p-methoxyphenyl)aminophenyl] ether of the present invention on general-purpose color formers in pressure-sensitive recording papers. Table 11 reveals the effect of addition of the triarylamine derivatives of the present invention on black color formers in heat-sensitive recording papers. Table 12 proves the effect of the addition of bis[p-bis(p-methoxyphenyl)aminophenyl] ether of the present invention on general-purpose color formers and color developers in heat-sensitive recording papers.

TABLE 9

| Example No. | Residual Ratio of Image (%) | Oxidation Potential (V) |
|---|---|---|
| Example 66 | 92 | 0.60 |
| Example 67 | 78 | 0.81 |
| Example 68 | 83 | 0.73 |
| Example 69 | 89 | 0.61 |
| Example 70 | 92 | 0.59 |
| Example 71 | 88 | 0.66 |
| Example 72 | 87 | 0.66 |
| Example 73 | 90 | 0.60 |
| Example 74 | 90 | 0.59 |
| Example 75 | 89 | 0.59 |
| Example 85 | 91 | — |
| Example 86 | 88 | — |

TABLE 9-continued

| Example No. | Residual Ratio of Image (%) | Oxidation Potential (V) |
|---|---|---|
| Compar. Example 39 | 66 | — |
| Compar. Example 40 | 69 | — |
| Compar. Example 41 | 67 | 0.92 |

TABLE 10

| Example No. | Residual Ratio of Image (%) | Compar. Example No. | Residual Ratio of Image (%) |
|---|---|---|---|
| 76 | 86 | 42 | 60 |
| 77 | 70 | 43 | 42 |
| 78 | 72 | 44 | 48 |
| 79 | 74 | 45 | 45 |
| 80 | 68 | 46 | 28 |
| 81 | 66 | 47 | 40 |
| 82 | 69 | 48 | 47 |
| 83 | 76 | 49 | 55 |
| 84 | 82 | 50 | 58 |
| 66 | 88 | 39 | 66 |

Note: Example and Comparative Example on the same line in Table 10 serve a comparison between the addition and non-addition of bis[p-bis(p-methoxyphenyl)aminophenyl]-ether to the same color former.

TABLE 11

| Example No. | Residual Ratio of Image (%) | Oxidation Potential (V) |
|---|---|---|
| Example 87 | 92 | 0.60 |
| Example 88 | 81 | 0.73 |
| Example 89 | 90 | 0.60 |
| Example 90 | 93 | 0.59 |
| Compar. Example 51 | 73 | — |
| Compar. Example 52 | 74 | — |

TABLE 12

| Example No. | Residual Ratio of Image (%) | Compar. Example No. | Residual Ratio of Image (%) |
|---|---|---|---|
| 91 | 93 | 53 | 70 |
| 92 | 96 | 54 | 74 |
| 93 | 95 | 55 | 82 |
| 94 | 96 | 56 | 80 |
| 95 | 90 | 57 | 75 |
| 87 | 92 | 51 | 73 |

Note: Example and Comparative Example on the same line in Table 12 serve a comparison between the addition and non-addition of bis[p-(p-methoxyhenyl)aminophenyl]-ether to the same color former or color developer.

As described and demonstrated above, the present invention provides a recording material which forms a color image of high light fastness.

While the invention has been described in detail and with reference to specific embodiments thereof, it will be apparent to one skilled in the art that various changes and modifications can be made therein without departing from the spirit and scope thereof.

What is claimed is:

1. A recording material employing an electron-donating achromatic dye and an electron-accepting compound, which further contains at least one triarylamine derivative represented by general formula (1), (2), or (4):

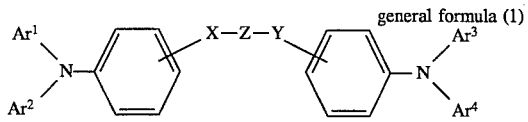

general formula (1)

wherein $Ar^1$, $Ar^2$, $Ar^3$, and $Ar^4$ each represents an unsubstituted aryl group or an aryl group substituted by an alkyl group, an alkenyl group, an alkynyl group, an aryl group, an alkoxy group, an aryloxy group, an alkylthio group, or an arylthio group, X and Y each represents an oxygen atom or a sulfur atom, and Z represents an alkylene group, a phenylene group, or an alkanedioyl group;

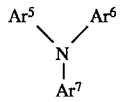

general formula (2)

wherein at least one of $Ar^5$, $Ar^6$, and $Ar^7$ represents an aryl group substituted by an alkoxy, an aryloxy group, an alkylthio group, or an arylthio group, and the remainder each represents an unsubstituted aryl group or an aryl group substituted by an alkyl group, an alkenyl group, an alkynyl group, an aryl group, an alkoxy group, an aryloxy group, an alkylthio group, or an arylthio group;

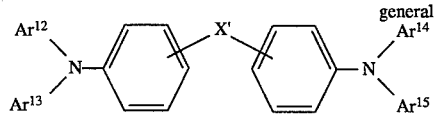

general formula (4)

wherein $Ar^{12}$, $Ar^{13}$, $Ar^{14}$ and $Ar^{15}$ each represents an unsubstituted aryl group or an aryl group substituted by an alkyl group, an alkenyl group, an alkynyl group, an aryl group, an alkoxy group, an aryloxy group, an alkylthio group, or an arylthio group; X' represents an oxygen atom, a sulfur atom or a bivalent linking group represented by general formula (a), (b) or (c)

general formula (a)

$$-C_kH_{2k}-$$

general formula (b)

$$-C_mH_{2m}-CH=CH-C_nH_{2n}-$$

general formula (c)

$$-C_pH_{2p}-C\equiv C-C_qH_{2q}-$$

wherein k is an integer of 2 to 20, and m, n, p and q each is an integer of 0 to 20.

2. A recording material as claimed in claim 1, wherein the triarylamine derivative represented by general formula (1), (2), (3) or (4) has an oxidation potential lower than that of triphenylamine.

3. A recording material as claimed in claim 2, wherein the triarylamine derivative represented by general formula (1) has an oxidation potential in the range of from 0.40 V to 0.90 V.

4. A recording material as claimed in claim 2, wherein the triarylamine derivative represented by general formula (2) has an oxidation potential in the range of from 0.40 V to 0.80 V.

5. A recording material as claimed in claim 2, wherein the triarylamine derivative represented by general formula (4) has an oxidation potential in the range of from 0.40 V to 0.90 V.

* * * * *